US010725392B2

(12) United States Patent
Kameya et al.

(10) Patent No.: US 10,725,392 B2
(45) Date of Patent: Jul. 28, 2020

(54) ELECTROSTATIC CHARGE IMAGE DEVELOPING TONER

(71) Applicant: Mitsubishi Chemical Corporation, Chiyoda-ku (JP)

(72) Inventors: Kumiko Kameya, Tokyo (JP); Tomoko Nakagawa, Tokyo (JP); Yuki Narukawa, Tokyo (JP); Masaya Ota, Tokyo (JP); Tetsuharu Yuge, Tokyo (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 16/516,923

(22) Filed: Jul. 19, 2019

(65) Prior Publication Data

US 2019/0339630 A1 Nov. 7, 2019

Related U.S. Application Data

(63) Continuation of application No. PCT/JP2018/001466, filed on Jan. 18, 2018.

(30) Foreign Application Priority Data

Jan. 20, 2017 (JP) ..... 2017-008706
Jan. 20, 2017 (JP) ..... 2017-008707
Jan. 27, 2017 (JP) ..... 2017-013610

(51) Int. Cl.
*G03G 9/08* (2006.01)
*G03G 9/093* (2006.01)
*G03G 9/09* (2006.01)

(52) U.S. Cl.
CPC ..... *G03G 9/09364* (2013.01); *G03G 9/0819* (2013.01); *G03G 9/0821* (2013.01); *G03G 9/0918* (2013.01); *G03G 9/09321* (2013.01)

(58) Field of Classification Search
CPC ..... G03G 9/0821
(Continued)

(56) References Cited

U.S. PATENT DOCUMENTS

2008/0025754 A1 1/2008 Ishiyama et al.
2016/0011534 A1 1/2016 Sano
2016/0179025 A1 6/2016 Nakagawa et al.

FOREIGN PATENT DOCUMENTS

JP 2008-033057 2/2008
JP 2008-145635 6/2008
(Continued)

OTHER PUBLICATIONS

International Search Report dated Feb. 13, 2018 in PCT/JP2018/001466 filed Jan. 18, 2018 (with English Translation).
(Continued)

*Primary Examiner* — Mark A Chapman
(74) *Attorney, Agent, or Firm* — Oblon, McClelland, Maier & Neustadt, L.L.P.

(57) ABSTRACT

The present invention relates to an electrostatic charge image developing toner, wherein when a tan δ measurement is performed twice by a rheometer, in the first measurement, a tan δ value measured at 130° C. is set as TP1 (130° C.), and a tan δ value measured at 140° C. is set as TP1 (140° C.), in the second measurement, a tan δ value measured at 140° C. is set as TP2 (140° C.), TP2 (140° C.)/TP1(140° C.) is equal to or smaller than 0.95, and TP1 (130° C.) is equal to or greater than 2.5.

12 Claims, 1 Drawing Sheet

(58) Field of Classification Search
USPC ..... 430/111.4
See application file for complete search history.

(56) References Cited

FOREIGN PATENT DOCUMENTS

| | | |
|---|---|---|
| JP | 2011-028150 | 2/2011 |
| JP | 2012-022331 | 2/2012 |
| JP | 2012-086593 | 4/2012 |
| JP | 2014-209188 | 11/2014 |
| JP | 2015-064573 | 4/2015 |

OTHER PUBLICATIONS

Written Opinion dated Feb. 13, 2018 in PCT/JP2018/001466 filed Jan. 18, 2018.

ELECTROSTATIC CHARGE IMAGE DEVELOPING TONER

TECHNICAL FIELD

The present invention relates to an electrostatic charge image developing toner which is capable of realizing both of an excellent fixability at a low temperature and hot offset resistance while maintaining a blocking resistance, and obtaining a high quality image even at the time of fixing at a low temperature.

BACKGROUND ART

The electrostatic charge image developing toner is used for image formation in which an electrostatic charge image is visualized in a printer, a copying machine, a facsimile, or the like. Taking the image formation by the electrophotographic method as an example, the image formation is performed by in such a manner that, first, an electrostatic latent image is formed on a photosensitive drum, which is then developed with a toner, transferred to transfer paper or the like, and fixed by heat or the like.

As the electrostatic charge image developing toner, for example, a toner in which a solid fine particle such as silica is attached to the surface as an external additive is generally used for the purpose that a charge control agent, a release agent, a magnetic material, and the like are dry-mixed in a binder resin and a colorant, as necessary, and then various performances such as fluidity are imparted to toner particles obtained by melt kneading with an extruder or the like, followed by pulverization and classification, a so-called melt-kneading pulverization method.

Further, according to the recent demands for high definition, production methods such as a suspension polymerization method, an emulsion aggregation method, a dissolution suspension method and the like, which are easy to control the particle diameter and particle size distribution of the toner, have been proposed.

In recent years, efforts to apply images obtained by electrophotographic method such as copying machines and printers to the professional field are actively conducted, and it has been necessary to beautifully output images such as photographs and graphics from the purpose of printing characters so far. For this reason, it is strongly desired that the output image has a higher quality image and higher glossiness than ever.

Since the electrophotographic apparatus is expected to simultaneously achieve low energy consumption and high-speed printing, the toner is strongly desired to be melted with low heat energy (time×temperature) and fixed on a medium, the excellent fixability at a low temperature is in an antinomic relation with the blocking resistance, and both of them are desired to be achieved. Various investigations have been performed so as to realize both of the excellent fixability at a low temperature and the blocking resistance.

On the other hand, with regard to the fixing temperature at the time of image output by the electrophotographic apparatus, the actual fixing temperature is not a constant value, but there is some nonuniformity. For example, when the image is output immediately after the power is turned on, the fixing temperature becomes low, but when continuous printing is performed from there, the fixing temperature becomes high. In addition, when the toner layer is thick (for example, toners of a plurality of colors are printed densely), the actual temperature applied to the toner layer is low, and when the toner layer is thin (for example, toners of a single color are printed thinly), the actual temperature applied to the toner layer is high.

In recent years, frequency of control of a fixing temperature of a heat roller has been reduced to reduce energy, so nonuniformity of the fixing temperature is easy to occur. When the fixing temperature is high, there arises a problem that hot offset (a phenomenon in which the toner on a transfer material adheres to a fixing member and then the toner transfers to the transfer material again to contaminate the transfer material) occurs. Therefore, a toner having good fixability even on a high temperature side is desired.

PTL 1 discloses a toner containing a crystalline polyester resin and a release agent, in which a structure in which the crystalline polyester resin is in contact with the releasing agent is present on a cross section of the toner dyed with ruthenium, and when a cross-sectional area for the structure is set as A, a cross-sectional area only for the release agent is set as B, and a cross-sectional area only for the crystalline polyester resin is set as C, relationships represented by $40 \leq 100 \times A/(A+B+C) \leq 70$, $10 \leq 100 \times B/(A+B+C) \leq 30$, and $20 \leq 100 \times C/(A+B+C) < 30$ are satisfied, fixability is less dependent on the fixing temperature, and a heat storage property is excellent.

PTL 2 proposes an electrostatic charge image developing toner containing a crystalline organic compound having a melting point of 50° C. to 150° C. as a fixing assistant for the purpose of heat resistant storage and low temperature fixing, in which in order to compatibilize a resin and the fixing assistant at the time of heating, in DSC measurement of toner, the amount of heat absorption at the melting maximum value derived from the fixing assistant at second temperature rise becomes smaller than that at first temperature rise, a glass transition temperature of the toner is more decreased than that the glass transition temperature of the resin, and the glass transition temperature at the second temperature rise becomes lower than that at the first temperature rise.

PTL 3 discloses an electrostatic charge image developing toner which is a core shell structure including a toner base particle and a shell layer, in which the toner base particle includes a resin coating layer formed of a water soluble resin on a surface of the toner base particle, and the shell layer on the resin coating layer.

PTL 4 proposes an electrostatic charge image developing toner which is a core shell structure including a toner base particle and a shell layer, in which a storage modulus (G') of a toner by a dynamic viscoelasticity test is adjusted in order to satisfy blocking resistance, excellent fixability at low temperature, and offset resistance.

CITATION LIST

Patent Literature

PTL 1: JP-A-2008-33057
PTL 2: JP-A-2012-22331
PTL 3: JP-A-2015-64573
PTL 4: JP-A-2011-28150

SUMMARY OF INVENTION

Technical Problem

However, although studies are performed in terms of the blocking resistance, the excellent fixability at a low temperature, and hot offset resistance separately in the toners described in any of the PTLs, coexistence thereof is insufficient.

An object of the present invention is to provide an electrostatic charge image developing toner which is capable of improving the excellent fixability at a low temperature and the blocking resistance while maintaining the blocking resistance.

Solution To Problem

The present inventors have found that as a toner which can realize both of the excellent fixability at a low temperature and the hot offset resistance while maintaining the blocking resistance, it is effective to adjust TP2 (140° C.)/TP1 (140° C.) to be described later and TP1 (130° C.) to be described later; temperature at which TP2 (140° C.)/TP1 (140° C.) to be described later and TP2A/TP1A to be described later show a minimum value; and TP2 (140° C.)/TP1 (140° C.) or TP2 (120° C.)/TP1 (120° C.) to be described later to within a specific range to achieve the present invention. The present invention is based on the above findings, and aspects of the present invention are as follows.

[1] An electrostatic charge image developing toner, wherein when a tan δ measurement is performed twice by a rheometer, in the first measurement, a tan δ value measured at 130° C. is set as TP1 (130° C.) and a tan δ value measured at 140° C. is set as TP1 (140° C.), and in the second measurement, a tan δ value measured at 140° C. is set as TP2 (140° C.), TP2 (140° C.)/TP1 (140° C.) is equal to or smaller than 0.95, and TP1 (130° C.) is equal to or greater than 2.5.

[2] The electrostatic charge image developing toner according to item [1], wherein TP2 (140° C.)/TP1 (140° C.) is equal to or greater than 0.50.

[3] The electrostatic charge image developing toner according to item [1] or [2], wherein TP1 (130° C.) is equal to or smaller than 4.0.

[4] The electrostatic charge image developing toner according to any one of items [1] to [3], comprising:

a toner base particle containing at least a binder resin and a colorant; and an external additive.

[5] The electrostatic charge image developing toner according to any one of items [1] to [4], wherein a storage modulus G' measured at 120° C. by a rheometer is equal to or lower than 2,000 Pa, and a softening point measured by a flow tester is equal to or higher than 105° C.

[6] The electrostatic charge image developing toner according to any one of items [1] to [5], comprising:

a core component containing at least a binder resin and a colorant; and a core/shell structure containing a shell component which has at least a binder resin present in surroundings thereof, wherein a degree of crosslinking of the core component is higher than a degree of crosslinking of the shell component, and a polarity of the shell component is higher than a polarity of the core component.

[7] The electrostatic charge image developing toner according to item [6], wherein a glass transition temperature of the binder resin contained in the core component is at least 5° C. lower than the glass transition temperature of the binder resin contained in the shell component.

[8] The electrostatic charge image developing toner according to any one of items [1] to [7], having a volume average particle diameter of 4 μm to 8 μm.

[9] The electrostatic charge image developing toner according to any one of items [1] to [8], having an average circularity of 0.95 to 0.99.

[10] The electrostatic charge image developing toner according to any one of items [1] to [9], comprising: a copper phthalocyanine dye pigment as a colorant.

[11] An electrostatic charge image developing toner, wherein when a tan δ measurement is performed twice by a rheometer, in the first measurement, a tan δ value measured at 140° C. is set as TP1 (140° C.) and a tan δ value measured at 80° C. to 150° C. is set as TP1A, and in the second measurement, a tan δ value measured at 140° C. is set as TP2 (140° C.) and a tan δ value measured at 80° C. to 150° C. is set as TP2A, TP2 (140° C.)/TP1 (140° C.) is equal to or smaller than 0.95, and a temperature at which TP2A/TP1A shows a minimum value is equal to or higher than 130° C.

[12] An electrostatic charge image developing toner, wherein when a tab δ measurement is performed twice by a rheometer, in the first measurement, a tab δ value measured at 140° C. is set as TP1 (140° C.), and in the second measurement, a tab δ value measured at 140° C. is set as TP2 (140° C.), TP2 (140° C.)/TP1 (140° C.) is 0.90 to 0.95; or when a tab δ measurement is performed twice by a rheometer, in the first measurement, a tab δ value measured at 120° C. is set as TP1 (120° C.), and in the second measurement, a tab δ value measured at 120° C. is set as TP2 (120° C.), TP2 (120° C.)/TP1 (120° C.) is 0.60 to 0.70.

[13] An electrostatic charge image developing toner, wherein a storage modulus G' measured at 120° C. by a rheometer is equal to or lower than 2000 Pa, and a softening point measured by a flow tester is equal to or higher than 105° C.

[14] The electrostatic charge image developing toner according to any one of items [11] to [13] comprising:

a core component containing at least a binder resin and a colorant; and a core/shell structure containing a shell component containing at least a binder resin present in surroundings thereof, wherein a degree of crosslinking of the core component is higher than a degree of crosslinking of the shell component, and a polarity of the shell component is higher than a polarity of the core component

[15] The electrostatic charge image developing toner according to item [14], wherein a glass transition temperature of the binder resin contained in the core component is at least 5° C. lower than the glass transition temperature of the binder resin contained in the shell component.

[16] The electrostatic charge image developing toner according to any one of items [11] to [15], having a volume average particle diameter of 4 μm to 8 μm.

[17] The electrostatic charge image developing toner according to any one of items [11] to [16], having an average circularity of 0.95 to 0.99.

Advantageous Effects of Invention

According to the present invention, an electrostatic charge image developing toner can be provided, which realizes both of the excellent fixability at a low temperature and the blocking resistance while maintaining the blocking resistance.

DESCRIPTION OF EMBODIMENTS

1. Measurement Method and Definition

Figure 1:
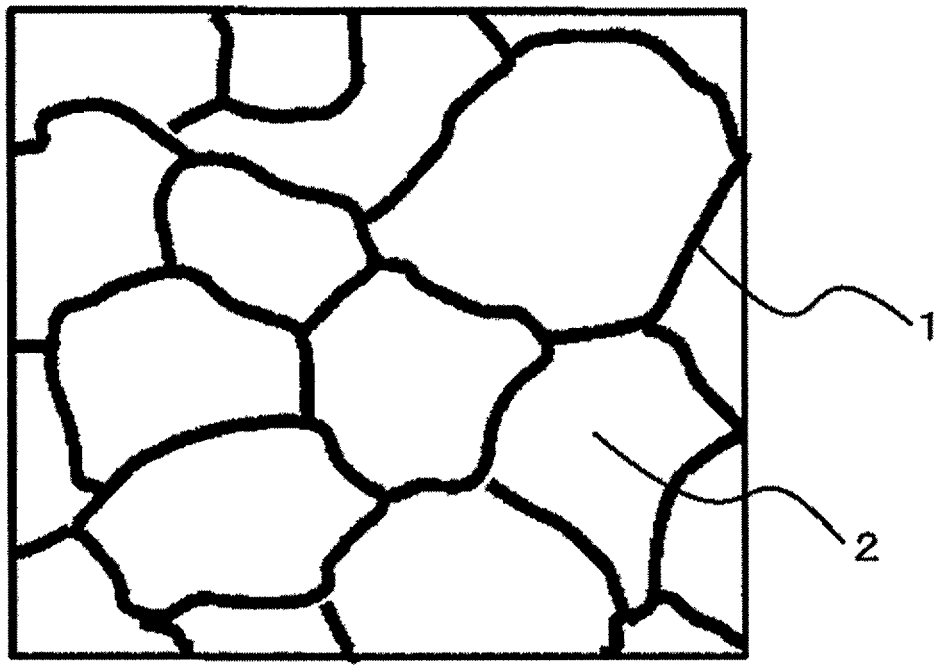
FIG. 1 is a conceptual diagram of a cross section of a molded body at the time of first measurement of an electrostatic charge image developing toner of the present invention by a rheometer.

In the present invention, a material before the addition of the external additive is referred to as external additive "toner base particle". Giving the external additive on the surface of the toner base particle may be referred to as "externally adding". A material having the external additive on the surface of the toner base particle is referred to as "toner" or "electrostatic charge image developing toner".

The measurement of the rheometer of the electrostatic charge image developing toner was performed by the method described in examples, a temperature, a storage modulus G', a loss modulus G", tan δ (that is, loss tangent=G"/G'), "TP1 (140° C.) which is a first measurement value of tan δ measured at 140° C.", "TP2 (140° C.) which is a second measurement value of tan δ measured at 140° C.", "TP1 (130° C.) which is a first measurement value of tan δ measured at 130° C.", and the like are defined to be measured by the measuring method described in examples. The "first temperature rise" and "second temperature rise" in the present invention is also defined as the temperature rise in the measurement method described in examples.

The electrostatic charge image developing toner of the present invention is a toner having (indicating) a numerical value (parameter) determined in Claims of the present application when measured by the measuring method (apparatus, setting, or the like) described in examples and the like. That is, even in a case where a numerical value (parameter) is measured by another apparatus or other setting, when the toner itself is measured by the measuring method described in examples and the like of the present specification, as long as the toner has (indicates) the numerical value (parameter), the toner is included in the present invention.

"A volume average particle diameter" in the present invention is "a volume median diameter ($Dv_{50}$)" measured by a method described in Examples unless otherwise specified.

Also, in the present specification, all percentages and parts represented by mass are the same as percentages and parts represented by weight.

Although details will be described later, the electrostatic charge image developing toner of the present invention preferably contains "a central portion (core) containing at least a binder resin and a colorant", a shell component present in surroundings thereof, and an external additive.

That is, the electrostatic charge image developing toner of the present invention is preferably a toner which contains a toner base particle having a core/shell structure containing a core component containing at least a binder resin and a colorant and a shell component containing at least the binder resin present in surroundings thereof, and an external additive.

In the present invention, "the core/shell structure" refers to a structure in which the shell component covers the surface of the core component, but is not limited to a structure in which the core component is completely covered by the shell component. The surface of the core component may be partially exposed, or a portion may be dispersed in the shell component.

In any method of preparing toner base particles as described below, the shell component refers to a material localized on a surface of the toner base particle. The shape of the shell component when being a toner may be a fine particle or a thin film, and further may continuously cover the core component or discontinuously cover the core component.

In a case of preparing the toner base particle in a wet medium where an aqueous and/or organic solvent is set as a continuous phase, a method of thermodynamically disposing the shell fine particle on an interface between the core component and the wet medium (a method of controlling the polarity) by adding the shell fine particle and the core component at the same time, a method of physically disposing the shell fine particle on the surface of the core component by adding the shell fine particle after adding the core component can be used. In addition, a combination of the method of thermodynamically disposing the shell fine particle on an interface between the core component and the wet medium (the method of controlling the polarity) and the method of physically disposing the shell fine particle on the surface of the core component by adding the shell fine particle after adding the core component can also be used.

In addition, in the case of adding the shell fine particle is added after adding the core component, an additional adding method after the composition and/or shape of the core component has been determined (the shape, physical properties, compatibilization, and the like of the core component may be changed by heating, aging, stirring, and the like thereafter) can be exemplified.

Hereinafter, the material where the shell fine particle component surrounds the core component is abbreviated as "shell" in some cases. In the toner in which the external additive is externally added to toner base particle, "the structure formed of the shell component and the external additive" is important in the present invention as a matter and concept for the above "core component" in measurement by a rheometer. Hereinafter, "the structure formed of the shell component and the external additive" may be abbreviated simply as "the structure" in some cases.

2. Definition of Electrostatic Charge Image Developing Toner 2.1. TP2 and TP1

A first embodiment of the electrostatic charge image developing toner of the present invention is an electrostatic charge image developing toner, in which when a tab δ measurement is performed twice by a rheometer, in the first measurement, a tab δ value measured at 130° C. is set as TP1 (130° C.), and a tab δ value measured at 140° C. is set as TP1 (140° C.), and in the second measurement, when a tab δ value measured at 140° C. is set as TP2 (140° C.), TP2 (140° C.)/TP1 (140° C.) is equal to or smaller than 0.95, and TP1 (130° C.) is equal to or greater than 2.5.

In this description, "TP2 (140° C.)/TP1 (140° C.)" means a value obtained by dividing TP2 (140° C.) with TP1 (140° C.).

Although it is obvious from that TP2 (140° C.)/TP1 (140° C.) is equal to or smaller than 0.95, it is preferable that TP2 and TP1 observed at 140° C. by a rheometer are not the same value. The value at 140° C. is used since it can be an indicator of offset resistance and glossiness when temperature of a fixing roller is assumed to be a relatively low temperature of about 150° C. It can be said that TP2 (140° C.)/TP1 (140° C.) equal to or smaller than 0.95 indicates that a change in the structure of the toner is caused by heating at the first measurement, and the reason for this is presumed as follows.

In the first measurement, as described in Examples, the toner is not heated as much as possible and is molded into a pellet so that there is no gap between the toners, and thus it is presumed that a sample having a "structure formed of the shell component and the external additive" which is unevenly distributed on the surface of the toner base particle as illustrated in FIG. 1" is measured. Since the shell component, which has lower elasticity than that of the core component of the toner base particle, forms a structure, in the first measurement, it is presumed that the storage modulus G' tends to be smaller than the loss modulus G" since the toner behaves more elastically, and thus tan δ (TP1) tends to be large.

On the other hand, in the second measurement, it is considered that a state in which the core component, the shell component, and the external additive are melted and mixed by heating and shearing at the first measurement so as to form a mixture, and the composition is averaged as compared with that in the first measurement, is measured. Therefore, the properties of the core component having higher elasticity than that of the shell component is emphasized, it is estimated that G" tends to be smaller than G' since the core component behaves more elastically, and thereby the tab δ (TP2) has a value smaller than the value of the first measurement. In other words, the rheological behavior thereof relatively measures the rheology of the structure for the first time, and the rheology of the mixture for the second time. Local elastic behavior of the mixture around 140° C. enables the toner to efficiently move from the fixing roller to the media.

In the first measurement with the rheometer, the "heating and shearing" is performed under static conditions, and the change in a small part of toner particle unit (for example, refer to FIG. 1) has occurred.

In order to keep the balance in which both of the excellent fixability at a low temperature and the hot offset resistance can be realized while maintaining the blocking resistance, TP2 (140° C.)/TP1 (140° C.) equal to or smaller than 0.95 is necessary. It is presumed that in the toner having this range, the shell component exists in a state of covering the surface of the toner base particle, and the external additive is externally added to the outside thereof, and the shell component and the core component are more compatible with each other to some extent at the second measurement than at the first measurement and further more compatible around 140° C., that is, the shell component and the core component are formed in an exquisite balance.

For example, if the core component and the shell fine particle component are completely different chemical components, or the shell fine particle component is a component having extremely high glass transition temperature (hereinafter sometimes referred to as only "Tg".) such as salt, the structural change does not occur, for example, the core component and the shell component are incompatible before and after the first measurement with the rheometer, and thus TP2 (140° C.)/TP1 (140° C.) approaches 1.

Since the above-described structure is formed of the shell component and the external additive, the toner is measured instead of measuring the toner base particles.

TP2 (140° C.)/TP1 (140° C.) measured at 140° C. by a rheometer is equal to or smaller than 0.95, and is preferably equal to or smaller than 0.93 in view of the offset resistance. Further, TP2 (140° C.)/TP1 (140° C.) is preferably equal to or greater than 0.50, is more preferably equal to or greater than 0.60, and is still more preferably equal to or greater than 0.70 in view of high glossiness.

Examples of a control means of TP2 (140° C.)/TP1 (140° C.) include the following.

In order to make TP2 (140° C.)/TP1 (140° C.) small, the toner has a core/shell structure and makes a difference in polarity between the core component and the shell fine particle component large (in a case where the shell fine particle and the core component are attached to each other in water, the polarity of the shell fine particle is designed to be larger and more hydrophilic than those of the core component), makes a molecular weight of the core component large, makes a crosslink density of the shell fine particle large, adds a third component which causes a crosslinking reaction such as ion crosslinking and metal crosslinking to the core component, introduces a monomer component which strengthens intermolecular force on a core component resin, makes the additional amount of the shell fine particle large, makes the coverage of the shell fine particle to the core component small, makes the shell fine particle into a thin film even with the same addition amount of the shell fine particle, makes the difference in polarity between the core component and the shell fine particle component in which the shell component is not penetrated into the core component, or the like. In order to make TP2 (140° C.)/TP1 (140° C.) large, an opposite design thereof may be performed.

It is preferable in view of the excellent fixability and hot offset resistance at a low temperature that the degree of crosslinking of the core component is higher than the degree of crosslinking of the shell component and the polarity of the shell fine particle component is higher than the polarity of the core component. As a result, it is possible to obtain a toner which satisfies the range of TP2 (140° C.)/TP1 (140° C.) and TP1 (130° C.).

TP1 (130° C.) indicating a formation state of the structure is equal to or greater than 2.5, and is preferably equal to or greater than 2.8 in view of the excellent fixability at a low temperature. TP1 (130° C.) is preferably equal to or smaller than 4.0, and is more preferably equal to or smaller than 3.5 in view of the blocking resistance. When the temperature of the fixing roller is assumed to be a relatively low temperature of about 150° C., the value at 130° C. is used since it can be an indicator of the excellent fixability and blocking resistance at a low temperature in a state in which the toner approaches the fixing roller in the fixing step. Since TP1 (130° C.) is equal to or greater than 2.5, the excellent fixability at a low temperature can be maintained.

A second embodiment of the electrostatic charge image developing toner of the present invention is an electrostatic charge image developing toner, in which a tan δ measurement is performed twice by a rheometer, in the first measurement, a tab δ value measured at 140° C. is set as TP1 (140° C.), and a tab δ value measured at 80° C. to 150° C. is set as TP1A, in the second measurement, a tab δ value measured at 140° C. is set as TP2 (140° C.) and a tab δ value measured at 80° C. to 150° C. is set as TP2A, TP2 (140° C.)/TP1 (140° C.) is equal to or smaller than 0.95, and a temperature at which TP2A/TP1A shows a minimum value is equal to or higher than 130° C.

The temperature at which TP2A/TP1A shows a minimum value indicates a temperature at which the core component and the shell component melt and mix to form a mixture and the elastic behavior of the core component is emphasized, and the temperature is equal to or higher than 130° C., preferably equal to or higher than 135° C. in view of the blocking resistance and hot offset resistance. The temperature is preferably equal to or lower than 145° C. in view of the excellent fixability at a low temperature.

TP1A and TP2A are continuous values at 80° C. to 150° C. TP2A/TP1A means a value obtained by dividing TP2A with TP1A, and is a ratio of values observed at the same temperature of 80° C. to 150° C.

A third embodiment of the electrostatic charge image developing toner of the present invention is an electrostatic charge image developing toner, in which when a tab δ measurement is performed twice by a rheometer, in the first measurement, a tab δ value measured at 140° C. is set as TP1 (140° C.), and in second measurement, a tab δ value measured at 140° C. is set as TP2 (140° C.), TP2 (140° C.)/TP1 (140° C.) is 0.90 to 0.95; or a tab δ measurement is performed twice by a rheometer, in the first measurement, a tab δ value measured at 120° C. is set as TP1 (120° C.), in second measurement, a tab δ value measured at 120° C. is set as TP2 (120° C.), TP2 (120° C.)/TP1 (120° C.) is 0.60 to 0.70.

In this description, "TP2 (120° C.)/TP1 (120° C.)" means a value obtained by dividing TP2 (120° C.) with TP1 (120° C.).

In particular, in a case of a magenta toner, since the viscosity tends to increase due to an influence of the colorant, the TP2 (140° C.)/TP1 (140° C.) is preferably 0.90 to 0.95.

TP1 (140° C.) is preferably equal to or greater than 2.3, and is more preferably equal to or greater than 3.0 in view of the excellent fixability at a low temperature. TP1 (140° C.) is preferably equal to or smaller than 5.0, and is more preferably equal to or smaller than 3.5 in view of the blocking resistance.

To fix at a lower temperature, an indicator of TP2 (120° C.)/TP1 (120° C.) is important. TP2 (120° C.)/TP1 (120° C.) is preferably equal to or smaller than 0.68 in view of the offset resistance and blocking resistance. TP2 (120° C.)/TP1 (120° C.) is equal to or greater than 0.60 in view of the high glossiness.

TP1 (120° C.) indicating a formation state of the structure is preferably equal to or greater than 2.1, and is more preferably equal to or greater than 2.4 in view of the excellent fixability at a low temperature. TP1 (120° C.) is preferably equal to or smaller than 4.0, and is more preferably equal to or smaller than 3.0 in view of the blocking resistance.

TP2 (120° C.) indicating a formation state of the structure after a structural change by heating and shear is preferably equal to or greater than 0.8, and is more preferably equal to or greater than 1.0 in view of the excellent fixability at a low temperature. TP2 (120° C.) is preferably equal to or smaller than 1.5, and is more preferably equal to or smaller than 1.3 in view of the blocking resistance.

2.2. Storage Modulus G'

In the electrostatic charge image developing toner of the present invention, the storage modulus G' at 120° C. measured by a rheometer at a shear rate of 1 Hz is preferably equal to or lower than 2000 Pa, more preferably equal to or lower than 1900 Pa, and still more preferably equal to or lower than 1500 Pa. A low viscosity under conditions of a low temperature and a low shear rate indicates that the toner can be sufficiently deformed even in a state where heating from a fixing device is not sufficient during low temperature fixing or high speed printing. Therefore, even during low temperature fixing or high speed printing, fixability to paper is good.

The storage modulus G' at 120° C. is mainly determined by a composition of the binder resin. In order to reduce the storage modulus G' at 120° C., it is possible to exemplify methods of reducing a molecular weight of the binder resin and lowering a glass transition temperature (Tg) of the binder resin. The storage modulus G' at 120° C. is preferably equal to or higher than 600 Pa, and more preferably equal to or higher than 800 Pa in view of the hot offset resistance.

Since it is necessary to pay attention to an area where the storage modulus G' at 120° C. is low, it is preferable to mold a sample into pellets having a large diameter and measure the sample as conditions suitable for measuring a sample having a low storage modulus G'.

2.3. Softening Point

In the electrostatic charge image developing toner of the present invention, a softening point measured by a flow tester is preferably equal to or higher than 105° C., more preferably equal to or higher than 106° C., and even more preferably equal to or higher than 107° C. The softening point is preferably equal to or lower than 115° C., and more preferably equal to or lower than 110° C. in view of fixability.

The softening point is a value obtained by a fast measurement method having a shear rate of about $10^{-1}$ to 100 $s^{-1}$. The high softening temperature under high shear conditions indicates that entanglement of polymer chains of the binder resin in the toner is sufficiently present. Therefore, during fixing, a cohesive force in a toner layer due to entanglement of the polymer chains exceeds an adhesion force of the toner and the heat roller, which makes it difficult to break the inside of the toner layer, thereby improving the hot offset resistance. Since it is necessary to pay attention to an area where the softening point is high, it is preferable to use a die having a heavy load and a diameter of 1 mm in the flow tester.

Further, after printing, it is hard to break the toner layer by an effect of entanglement of the polymer chains inside the toner layer, and fixing strength measured by a peeling test using a tape or the like is good.

The softening point is mainly determined by the composition of the binder resin. In order to increase the softening point, it is possible to exemplify methods of increasing the crosslinking density of the binder resin, adding the third component that causes a crosslinking reaction such as ion crosslinking and metal crosslinking, and introducing a monomer component that strengths an intermolecular force.

The electrostatic charge image developing toner of the present invention is adjusted by decreasing a molecular weight peak of the binder resin and increasing the crosslinking density, combining a plurality of binder resins having different molecular weights, and the like since both the storage modulus G' measured at 120° C. by a rheometer and the softening point measured by a flow tester are within a predetermined range.

Accordingly, it is possible to fix well during low temperature fixing or high speed printing and to obtain sufficient fixing strength at the same time. Further, although the toner having a high softening point tends to have low glossiness, the storage modulus G' measured at 120° C. by a rheometer is low, so that a good gloss can be obtained.

When the toner has the above-mentioned core/shell structure, it is effective to lower the glass transition temperature of the binder resin when the storage modulus G' measured at 120° C. by a rheometer is controlled in a predetermined range, but the blocking resistance may be insufficient at that time.

At this time, as the core/shell structure of the toner, sufficient blocking resistance can be obtained while controlling the storage modulus G' measured at 120° C. by a rheometer in a predetermined range by adjusting the glass transition temperature of the resin used for the shell to be higher than the glass transition temperature of the resin used for the core.

2.4. Glass Transition Temperature (Tg)

Further, in view of realizing both of the excellent fixability at a low temperature and the high glossiness, the Tg measured by the differential scanning calorimeter (DSC) of the toner is also important even at the time of fixing at low temperature or at the time of printing at high speed while maintaining the blocking resistance, and the range of Tg of the toner is preferably equal to or lower than 50.0° C., is more preferably equal to or lower than 47.0° C., and is still more preferably equal to or lower than 45.0° C. In addition, the range of Tg of the toner is preferably equal to higher than 37.0° C., and is more preferably equal to higher than 40.0° C.

When the Tg is adjusted to this range, it is possible to obtain the excellent fixability at a low temperature and the high glossiness more preferably while maintaining the blocking resistance within the range where the core component and the shell fine particle component are adjusted to the above-described suitable range. The reason for this is that it is possible to compensate for the blocking resistance by raising the Tg of the toner to lower the Tg of the toner so that the excellent fixability at a low temperature and the gloss can be adjusted to be in a more preferable range.

In order to raise the Tg of the toner, it is preferable to increase the copolymerization ratio of the monomer component having a high Tg, to reduce the molecular weight (Mc) component which is not more than twice the molecular weight between entanglement points (for example, to decrease the molecular weight modifier and the like, or increase the amount of a crosslinking agent), and to increase the plasticizer (for example, wax, and crystalline resin) having a melting point equal to or lower than 100° C. to plasticize the binder resin. On the other hand, in order to make the Tg of the toner low, an opposite design thereof may be performed. In addition, "a monomer component having a high Tg" is a monomer component which constitutes a homopolymer having a high Tg.

2.5. Composition of Toner Base Particle 2.5.1. Core (Center Potion) Component

The electrostatic charge image developing toner of the present invention preferably contains a toner base particle. The toner base particle obtained by covering "a core component containing at least binder resin (for example, formed of a primary polymer particle) and a colorant" by the shell fine particle.

The shell fine particle may also contain a charge control agent and the like if necessary, and it is preferable that the wax is contained from the viewpoint of prevention of offset on a high temperature side, and furthermore, when this wax is contained in a state of being substantially enclosed by the binder resin, it is possible to solve the problem caused by wax release such as filming, which is more preferable.

In order to make the wax substantially enclosed in the binder resin, a method of polymerizing, precipitating, or aggregating the binder resin on the surface of the wax by the presence of wax particles in water and/or an organic solvent can be exemplified.

As the binder resin, any binder resin may be used as long as it is generally used as a binder resin in the preparing of the toner, and is not particularly limited, but examples thereof include a thermoplastic resin such as a polystyrene resin, a poly (meth) acrylic resin, a polyolefin resin, an epoxy resin, a polyester resin, and a mixture of these resins.

As a monomer component used for preparing the binder resin, the monomers used for generally preparing the binder resin of the toner can be appropriately used. For example, it is also possible to use any polymerizable monomer among a polymerizable monomer having an acidic group (hereinafter, may be simply referred to as an acidic monomer), a polymerizable monomer having a basic group (hereinafter, may be simply referred to as a basic monomer), and a polymerizable monomer having neither an acidic group nor a basic group (hereinafter, may be simply referred to as other monomers).

In a case where a polystyrene resin and a poly (meth) acrylic resin arc used as the binder resin, the following monomers are exemplified as examples.

Examples of the acidic monomer include a polymerizable monomer having a carboxyl group such as acrylic acid, methacrylic acid, maleic acid, fumaric acid, and cinnamic acid; a polymerizable monomer having sulfonic acid groups such as sulfonated styrene; and a polymerizable monomer a sulfonamide group such as vinyl benzene sulfonamide.

Examples of the basic monomer include an aromatic vinyl compound having an amino group such as aminostyrene; a polymerizable monomer having a nitrogen-containing heterocyclic ring such as vinyl pyridine and vinyl pyrrolidone; and (meth)acrylic ester having an amino group such as dimethyl aminoethyl acrylate and diethyl aminoethyl methacrylate.

These acidic monomer and basic monomer contribute to dispersion stabilization of the toner base particle. These may be used alone or plural kinds thereof may be used in combination, and it may be present as a salt with a counter ion.

Further, although these acidic monomer and basic monomer may be contained in one or both of the core component and the shell fine particle of the toner base particle, "a resin component formed of a binder resin and an acidic or basic monomer" constituting the core component and "a resin component formed of a binder resin and an acidic or basic monomer" constituting the shell fine particle are preferably not the same composition. The shell component and the core component are more compatible with each other to some extent at the second measurement than at the first measurement of tan 6, that is, the shell component and the core component need to be formed in an exquisite balance, and thus it is particularly important in the present invention from the aspect that the appropriate affinity therebetween is adjusted.

In addition, in a case of manufacturing the toner base particle by attaching the shell fine particle to the core component in water, for an acid value (base number) depending on the additional amount of the acidic (or basic) monomer, it is preferable to increase the acid value (base number) of the shell fine particle component than the core component of the toner base particle, and specifically, it is preferable to adjust the acid value (base number) of the shell fine particle component to be 1.1 times to 2.6 times of the acid value (base number) of the core component. When the above magnification is excessively small, the shell fine particle may buried in the core component, satisfactory blocking resistance may not be obtained, and when the above magnification is excessively large, the shell tine particle is excessively stable in water as compared to the core component, and thus is not attached in some cases.

Examples of other monomers include styrenes such as styrene, methyl styrene, chlorostyrene, dichlorostyrene, p-t-butyl styrene, p-n-butyl styrene, and p-n-nonylstyrene; acrylic acid esters such as methyl acrylate, ethyl acrylate, propyl acrylate, n-butyl acrylate, isobutyl acrylate, hydroxyethyl acrylate, and 2-ethyl hexyl acrylate; methacrylic esters such as methyl methacrylate, ethyl methacrylate, propyl methacrylate, n-butyl methacrylate, isobutyl methacrylate, hydroxyethyl methacrylate, and 2-ethyl hexyl methacrylate; and acrylamides such as acrylamide, N-propyl acrylamide, N,N-dimethyl acrylamide, N,N-dipropyl acrylamide, and N,N-dibutyl acrylamide.

The other monomers may be used alone or a plurality of kinds thereof may be used in combination.

In a case where the binder resin is a crosslinkable resin, a polyfunctional monomer is used together with the above-described polymerizable monomers, and examples thereof include divinyl benzene, hexanediol diacrylate, ethylene glycol dimethacrylate, diethylene glycol dimethacrylate, triethylene glycol dimethacrylate, tetraethylene glycol dimethacrylate, hexaethylene glycol dimethacrylate, nonaethylene glycol dimethacrylate, diethylene glycol diacrylate, triethylene glycol diacrylate, neopentyl glycol dimethacrylate, neopentyl glycol diacrylate, and diallyl phthalate.

Among them, bifunctional polymerizable monomers are preferable, and divinyl benzene, hexanediol diacrylate and the like are particularly preferable. These multifunctional polymerizable monomers may be used alone or two or more kinds thereof may be used in combination. It is also possible to use polymerizable monomers having a reactive group in a pendant group, such as glycidyl methacrylate, methylol acrylamide, acrolein, and the like.

Known chain transfer agents can be used as necessary for adjustment of the molecular weight (number average molecular weight, weight average molecular weight) of the binder resin. Specific examples of the chain transfer agent include t-dodecyl mercaptan, dodecane thiol, diisopropyl xanthogen, carbon tetrachloride, and trichlorobromomethane. The chain transfer agent may be used alone or two or more kinds thereof may be used in combination, and 0% to 5% by mass based on the polymerizable monomer is preferably used.

In a case where a polystyrene resin and a poly(meth) acrylic resin are used as a binder resin, the number average molecular weight in gel permeation chromatography (hereinafter, referred to as GPC) is preferably equal to or greater than 5,000, more preferably equal to or greater than 8,000, and still more preferably equal to or greater than 10,000, and is preferably equal to or less than 30,000, more preferably equal to or less than 20,000, and still more preferably equal to or less than 15,000.

The weight average molecular weight in GPC is preferably equal to or more than 70,000, and is more preferably equal to or more than 90,000, and is preferably equal to or less than 300,000, and is more preferably equal to or less than 250,000.

In a case of using a polyester resin as a binder resin, examples of divalent Polyester which is a constituent component of the polyester resin include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol; and a bisphenol A alkylene oxide adduct such as bisphenol A, hydrogenated bisphenol A, polyoxyethylenated bisphenol A, and polyoxypropylenated bisphenol A.

Examples of the divalent acid which is a constituent component of the polyester resin include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and anhydride of these acids, or lower alkyl ester; alkenyl succinic acids or alkyl succinic acids such as n-dodecenyl succinic acid and n-dodecyl succinic acid; and other divalent organic acids.

In a case where the binder resin is used as a crosslinkable resin, multifunctional monomers such as trivalent or higher polyhydric alcohols and trivalent or higher acids are used together with the divalent alcohols and acids described above.

Examples of trivalent or more polyhydric alcohol include sorbitol, 1,2,3,6-hexane tetrol, 1,4-sorbitan, pentaerythritol, dipentaerythritol, tripentaerythritol, sucrose, 1,2,4-butanetriol, 1,2,5-pentanetriol, glycerol, 2-methylpropane triol, 2-methyl-1,2,4-butanetriol, trimethylolethane, trimethylolpropane, 1,3,5-trihydroxymethyl benzene, and others.

Examples of the trivalent or more acid include 1,2,4-benzene tricarboxylic acid, 1,2,5-benzene tricarboxylic acid, 1,2,4-cyclohexane tricarboxylic acid, 2,5,7-naphthalene tricarboxylic acid, 1,2,4-naphthalene tricarboxylic acid, 1,2,5-hexane tricarboxylic acid, 1,3-dicarboxyl-2-methyl-2-methylene carboxypropane, tetra(methylene carboxyl) methane, 1,2,7,8-octane tetracarboxylic acid, anhydrides of the acids, and others.

In addition, in a case of manufacturing the toner base particle by attaching the shell fine particle to the core component in water, for an acid value of the polyester resin, it is preferable to increase the acid value of the shell fine particle component than the core component of the toner base particle, and specifically, it is preferable to adjust the acid value of the shell fine particle component to be 1.1 times to 2.6 times of the acid value of the core component.

These polyester resins can be synthesized by a general method. Specifically, conditions such as a reaction temperature (170° C. to 250° C.), a reaction pressure (5 mmHg to atmospheric pressure), and the like are determined according to the reactivity of the monomer, and the reaction may be completed when predetermined physical properties are obtained. The number average molecular weight in GPC when the polyester resin is used as a binder resin is preferably 2,000 to 20,000, and is more preferably 3,000 to 12,000.

In the electrostatic charge image developing toner, as an offset preventing agent, and in order to improve the fixability at a low temperature, waxes are preferably used. As the waxes used in the electrostatic charge image developing toner of the present invention, specific examples thereof include olefin wax such as low molecular weight polyethylene, low molecular weight polypropylene, and copolymer polyethylene; paraffin wax; ester wax having a long chain aliphatic group such as behenyl behenate, montanic acid ester, and stearyl stearate; plant wax such as hydrogenated castor oil and carnauba wax; ketone having a long-chain alkyl group such as distearyl ketone; silicone having an alkyl group; higher fatty acid such as stearic acid; a polyhydric alcohol ester of a long-chain fatty acid (pentaerythritol, trimethylolpropane, glycerin, or the like) or a partial ester thereof; and higher fatty acid amide such as oleic acid amide and stearic acid amide.

Preferable examples of the waxes used in the electrostatic charge image developing toner of the present invention include hydrocarbon wax such as paraffin wax and Fischer-Tropsch wax; ester wax; and silicone wax.

Among them, ester wax is more preferable, monoester wax mainly containing a hydrocarbon having C18 and/or C22 is still more preferable, and wax mainly containing behenyl behenate, stearyl behenate, and behenyl stearate is particularly preferable. The above-described waxes may be used alone or may be used in combination.

A melting point peak temperature of the wax (endothermic peak top at the second temperature rise of Tg measurement by DSC of the toner) is preferably equal to or lower than 90° C., is more preferably equal to or lower than 85° C., and is still more preferably equal to or lower than 80° C., and is preferably equal to or greater than 50° C., is more preferably equal to or greater than 60° C., and is still more preferably equal to or greater than 65° C. In a case where the melting peak temperature of the wax is too low, the blocking resistance tends to be deteriorated, and in a case where the melting peak temperature of the wax is too high, the excellent fixability at a low temperature and the high glossiness tend to be damaged. In addition, a difference between the melting point peak temperature of the wax and an onset temperature of the wax (an intersection temperature of the baseline before the endothermic peak in the second Tg measurement by DSC of the toner, and a tangent at the first inflection point appearing before the endothermic peak) is preferably equal to or lower than 15° C., and is more preferably equal to or lower than 10° C.

Further, the onset temperature of the wax is preferably equal to or lower than 86° C., is more preferably equal to or lower than 81° C., and is still more preferably equal to or lower than 76° C., and is preferably equal to or higher than 46° C., is more preferably equal to or higher than 56° C., and is still more preferably equal to or higher than 61° C. In a case where the onset temperature is low, the excellent fixability at a low temperature and the high glossiness tend to be enhanced, and in a case where the onset temperature is high, the blocking resistance tends to be enhanced.

The use amount of the wax is preferably equal to or more than 1 part by mass, is more preferably equal to or more than 2 parts by mass, and is still more preferably equal to or more than 5 parts by mass, with respect to 100 parts by mass of the toner. In addition, the amount of the wax is preferably equal to or less than 35 parts by mass, is more preferably equal to or less than 30 parts by mass, and is still more preferably equal to or less than 25 parts by mass.

As a colorant, any known colorant can be used. Specific examples of the colorant include any known dye pigment such as carbon black, aniline blue, phthalocyanine blue, phthalocyanine green, hansa yellow, rhodamine dye pigment, chrome yellow, quinacridone, benzidine yellow, rose bengal, a triallyl methane dye pigment, a monoazo dye pigment, a disazo dye pigment, and a condensed azo dye pigment may be used alone or in combination.

In a case of full-color toner, a monoazo dye pigment, a diazo dye pigment, a polyazo dye pigment, and a condensed azo dye pigment are preferably used as yellow; a quinacridone dye pigment and/or a monoazo dye pigment are preferably used as magenta; a phthalocyanine dye pigment is preferably used as cyan; and carbon black is preferably used as black.

In view of adjusting TP2 (140° C.)/TP1 (140° C.) as a combination of toner sets, the magenta toner preferably contains a quinacridone dye pigment and/or a monoazo dye pigment, a black toner preferably contains carbon black, a cyan toner preferably contains a phthalocyanine copper dye pigment, and a yellow toner preferably contains at least one dye pigment selected from the monoazo dye pigment, the disazo dye pigment, and the condensed azo dye pigment.

Specific examples of the cyan can include C.I. Pigment Blue 15:3 and C.I. Pigment Blue 15:4; specific examples of the yellow can include C.I. Pigment Yellow 74, C.I. Pigment Yellow 83 which is a disazo dye pigment, C.I. Pigment Yellow 93 which is a condensed azo dye pigment, C.I. Pigment Yellow 155, C.I. Pigment Yellow 180, and C.I. Pigment Yellow 185; specific examples of the magenta can include C.I. Pigment Red 48:1, C.I. Pigment Red 53:1, C.I. Pigment Red 57:1, C.I. Pigment Red 5, C.I. Pigment Red 122 which is a quinacridone dye pigment, C.I. Pigment Red 209, and C.I. Pigment Red 269 (238) which is a monoazo dye pigment. The colorant is preferably used in an amount of 3 parts by mass to 20 parts by mass with respect to 100 parts by mass of the toner.

Any known charge control agent can be used. Specific examples of the charge control agent include a nigrosine dye, an amino group-containing vinyl copolymer, a quaternary ammonium salt compound, and a polyamine resin for positive charging; a metal-containing azo dye containing a metal such as chromium, zinc, iron, cobalt, and aluminum, a salt of salicylic acid or alkyl salicylic acid with the metal described above, and a metal complex for negative charging.

The amount of the charge control agent is preferably 0.1 to 25 parts by mass, and is more preferably 1 to 15 parts by mass, with respect to 100 parts by mass of the toner. The charge control agent may be mixed into the toner base particle, or may be used in a state of being attached to the surface of the toner base particle.

2.5.2. Components of Shell Fine Particle

The toner base particle is formed of the core component and the shell fine particle that exists surrounding the core component. As other components if necessary, wax, a charge control agent, and the like may be contained in the core component and/or shell fine particle. The core component and/or shell fine particle preferably contains wax.

As a type of the "shell fine particle component" which is a component of the shell fine particle, generally, the resin used as a binder resin at the time of preparing the toner can be exemplified. The type of the resin is not particularly limited, but examples thereof include a thermoplastic resin such as a polystyrene resin, a poly (meth) acrylic resin, a polyolefin resin, an epoxy resin, a polyester resin, and a mixture of these resins. A detailed selecting method of the resin will be described below.

2.6. Toner Formation

The volume average particle diameter of the electrostatic charge image developing toner of the present invention is preferably equal to or greater than 4 μm, and is more preferably equal to or greater than 5 μm. The volume average particle diameter is equal to or smaller than preferably 8 μm, more preferably equal to or smaller than 7 μm.

For the shape of the electrostatic charge image developing toner of the present invention, the average circularity measured by using a flow-type particle image analyzer FPIA-3000 is preferably equal to or greater than 0.95, is more preferably equal to greater than 0.96, and is still further preferably equal to or greater than 0.99.

3. Preparing of Electrostatic Charge Image Developing Toner

The electrostatic charge image developing toner of the present invention may be prepared by any known method, and is not particularly limited.

3.1. Method of Preparing of Toner Base Particle 3.1.1. Method of Preparing Toner Base Particle by Aggregating Toner Base Particles Smaller than Toner Base Particle It is possible to use a method of obtaining a toner base particle by preparing each raw material as particles smaller than the toner base particle size and mixing and aggregating the small particles.

3.1.1.1. Emulsion Polymerization

A method of obtaining a dispersion of the primary polymer particle by preparing the binder resin as a "primary polymer particle" smaller than the toner base particle, will be described below. In addition, a method similar to this can also be used for preparing the shell fine particle.

A polymer primary particle containing a styrene or (meth) acrylic monomer as a constituent can be obtained by polymerizing the monomer composition and, if necessary, a chain transfer agent with an emulsifier, followed by emulsion polymerization. Known emulsifiers can be used, but one or more emulsifiers selected from cationic surfactants, anionic surfactants, and nonionic surfactants can be used in combination.

Examples of the cationic surfactant include dodecyl ammonium chloride, dodecyl ammonium bromide, dodecyl trimethyl ammonium bromide, dodecyl pyridinium chloride, dodecyl pyridinium bromide, and hexadecyl trimethyl ammonium bromide.

Examples of the anionic surfactant include fatty acid soap such as sodium stearate and sodium dodecanoate, sodium dodecyl sulfate, sodium dodecylbenzene sulfonate, and sodium lauryl sulfate.

Examples of the nonionic surfactant include polyoxyethylene dodecyl ether, polyoxyethylene hexadecyl ether, polyoxyethylene nonyl phenyl ether, polyoxyethylene lauryl ether, polyoxyethylene sorbitan monooleate ether, and monodecanoyl sucrose.

The use amount of the emulsifier is preferably 0.1 parts by mass to 10 parts by mass with respect to 100 parts by mass of the polymerizable monomer. When the use amount of the emulsifier is increased, the particle diameter of the obtained polymer primary particle becomes smaller, and when the use amount of the emulsifier is reduced, the particle diameter of the obtained polymer primary particle becomes larger. In addition, one or two or more kinds of polyvinyl alcohols such as partially or completely saponified polyvinyl alcohol, cellulose derivatives such as hydroxyethyl cellulose, and the like can be used as a protective colloid in combination with these emulsifiers.

If necessary, known polymerization initiators may be used alone or two or more kinds thereof may be used in combination. For example, a redox initiator combining persulfates such as potassium persulfate, sodium persulfate, and ammonium persulfate, and these persulfates as a component with a reducing agent such as acidic sodium sulfite; a soluble polymerization initiator such as hydrogen peroxide, 4,4'-azobiscyanovaleric acid, t-butyl hydroperoxide, cumene hydroperoxide; and a redox initiator combining these water-soluble polymerization initiators as a component with a reducing agent such as a ferrous salt, benzoyl peroxide, and 2,2'-azobis-isobutyronitrile can be used. These polymerization initiators may be added to the polymerization system before, simultaneously with, or after the addition of the polymerizable monomer, and these addition methods may be combined if necessary.

In order to disperse the wax in a suitable dispersed particle diameter in the toner, it is preferable to use so-called seed polymerization in which wax is added as a seed during the emulsion polymerization. By adding as a seed, the wax is finely and uniformly dispersed in the toner, so that deterioration of the chargeability and heat resistance of the toner can be suppressed. Also, a wax/long chain polymerizable monomer dispersion obtained by dispersing a wax with a long chain polymerizable monomer such as stearyl acrylate in advance in an aqueous dispersion medium is prepared, and the polymerizable monomer can also be polymerized in presence of the wax/long chain polymerizable monomer.

It is also possible to emulsion polymerize using a colorant as a seed, but when a polymerizable monomer is polymerized in the presence of the colorant, the metal in the colorant affects the radical polymerization, the control of the molecular weight and rheology of the resin is difficult, and desired physical properties cannot be obtained, and thereby a method of adding the colorant dispersion in the subsequent step without adding the colorant at the time of emulsion polymerization.

3.1.1.2. Method of Emulsifying Resin

The polymer primary particle is obtained by obtaining a resin by methods such as a bulk polymerization method, a solution polymerization method, a suspension polymerization method, and an emulsion polymerization method, then mixing the resin with an aqueous medium, heating to a temperature higher than either the melting point of the resin or the glass transition temperature to a temperature, and lowering the viscosity of the resin, and applying a shearing force to perform emulsification.

As an emulsifier for giving a shearing force, for example, a homogenizer, a homomixer, a pressure kneader, an extruder, a media disperser and the like can be mentioned. In the case where the viscosity of the resin at the time of emulsification is high and it is not reduced to a desired particle diameter, having a desired particle diameter can be obtained by raising the temperature using an emulsifying device capable of pressurizing to be equal to or higher than atmospheric pressure and emulsifying it while lowering the resin viscosity.

As another method, a method of lowering the viscosity of the resin by previously mixing an organic solvent into the resin may be used. The organic solvent to be used is not particularly limited as long as it dissolves the resin, ketone solvents such as tetrahydrofuran (THF), methyl acetate, ethyl acetate, methyl ethyl ketone, and the like, and benzene solvents such as benzene, toluene, xylene, and the like can be used. Further, for the purpose of improving the affinity with an aqueous medium and controlling the particle size distribution, an alcohol solvent such as ethanol or isopropyl alcohol may be added to water or a resin. In a case where an organic solvent is added, it is necessary to remove the organic solvent from the emulsion after completion of emulsification. As a method for removing the organic solvent, there is a method of volatilizing the organic solvent while reducing the pressure at normal temperature or under heating.

For the purpose of controlling the particle size distribution, salts such as sodium chloride and potassium chloride, ammonia, and the like may be added. For the purpose of controlling the particle size distribution, an emulsifier or a dispersant may be added. Examples thereof include a soluble polymer such as polyvinyl alcohol, methyl cellulose, carboxymethyl cellulose, and sodium polyacrylate; the above-mentioned emulsifier; an inorganic compound such as tricalcium phosphate, aluminum hydroxide, calcium sulfate, calcium carbonate, and barium carbonate. The use amount is preferably 0.01 to 20 parts by mass with respect to 100 parts by mass of the resin. When a resin containing an acidic group or a basic group is used, it is possible to reduce the amount of the emulsifier or dispersant to be added, but the hygroscopic property of the resin is increased and the chargeability may be deteriorated in some cases.

A phase inversion emulsification method may also be used. In the phase inversion emulsification method, an organic solvent, a neutralizing agent, and a dispersion stabilizer are added to a resin, as necessary, and an aqueous medium is added dropwise under stirring to obtain emulsified particles, and then the organic solvent in the resin dispersion is removed so as to obtain an emulsion. As the organic solvent, the same organic solvents as those described above can be used. As the neutralizing agent, common acids such as nitric acid, hydrochloric acid, sodium hydroxide, ammonia, and alkalis can be used.

3.1.1.3. Formation of Toner Base Particle by Aggregating/Aging

In any of the above preparation methods of emulsion polymerization and resin emulsification, the volume average particle diameter of the obtained polymer primary particle is generally equal to or larger than 0.02 μm, is preferably equal to or larger than 0.05 μm, and is particularly preferably equal to or larger than 0.1 μm, and is generally equal to or smaller than 3 μm, is preferably equal to or smaller than 2 μm, and is particularly preferably equal to or smaller than 1 μm.

When the volume average particle diameter of the polymer primary particle is equal to or greater than the lower limit value, it is easy to control the aggregation rate in the aggregation step. On the other hand, when the volume average particle diameter of the polymer primary particle is equal to or smaller than the upper limit value, the particle diameter of the toner base particle obtained by aggregation is difficult to be large and it is easy to obtain the toner base particle having a target particle diameter in some cases.

In the aggregation step, the above-mentioned polymer primary particle, the colorant particle, and a charge control agent and wax combined as necessary are mixed simultaneously or sequentially. A dispersion of each component, that is, a polymer primary particle dispersion, a colorant particle dispersion, if necessary a charge control agent dispersion, and a wax fine particle dispersion are prepared in advance, it is preferable to mix these to obtain a mixed dispersion in view of uniformity of composition and uniformity of particle diameter. The colorant is preferably used in a state of being dispersed in water in the presence of an emulsifier, and the volume average particle diameter of the colorant particle is preferably equal to or larger than 0.01 μm, and is particularly preferably equal to or larger than 0.05 μm, and is preferably equal to or smaller than 3 μm, and is particularly preferably equal to or smaller than 1 μm.

In the aggregation step, aggregation is generally performed in a tank provided with a stirring device, but there are a heating method, an electrolyte addition method, and a combination thereof. In a case of aggregating polymer primary particles under agitation so as to obtain particle agglomerates of a desired size, the particle diameter of the particle agglomerate is controlled from the balance between the cohesive force between the particles and the shear force by stirring, but it is possible to increase the cohesive force by heating or by adding an electrolyte.

As an electrolyte in a case of performing the aggregation by adding an electrolyte, any of acid, alkali and salt may be used, and either organic or inorganic type may be used, and specifically, examples of the acid include hydrochloric acid, nitric acid, sulfuric acid, and citric acid; examples of the alkali include sodium hydroxide, potassium hydroxide, aqueous ammonia; and examples of the salt include NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$, and $C_6H_5SO_3Na$. Among them, an inorganic salt having a polyvalent metal cation having two or more valences is preferable.

The additional amount of the electrolyte varies depending on the kind of the electrolyte, the desired particle diameter, and the like, but is preferably equal to or greater than 0.02 parts by mass, and is more preferably equal to or greater than 0.05 parts by mass with respect to 100 parts by mass of the solid component of the mixed dispersion. In addition, the additional amount of the electrolyte is preferably equal to or less than 25 parts by mass, is more preferably equal to or less than 15 parts by mass, and is particularly preferably equal to or less than 10 parts by mass. When the additional amount is excessively small, the progress of aggregation slows down, fine powder equal to or smaller than 1 μm remains even after aggregation, and problems in that the average particle diameter of the obtained particle agglomerate does not reach the target particle diameter, and the like may occur. On the other hand, when the additional amount is excessively large, it tends to be rapidly aggregated and it becomes difficult to control the particle diameter, and the obtained aggregated particles may contain coarse or irregular powders in some cases.

The aggregation temperature in the case where aggregation was performed by adding the electrolyte is preferably equal to or higher than 20° C., and is particularly preferably equal to or higher than 30° C., and is preferably equal to or lower than 70° C., and is particularly preferably equal to or lower than 60° C.

The time required for aggregation is optimized depending on the shape of the apparatus and the processing scale, but in order for the particle diameter of the toner base particle to reach the target particle diameter, it is preferable to hold at least 30 minutes at the above-described predetermined temperature. Temperature rise until reaching a predetermined temperature may be raised at a constant rate or may be increased stepwise.

The shell fine particle may be added at any timing, may be charged with the raw material of the core component (for example, a primary polymer particle, a pigment, and wax) at the same time, or may be added after a part or all of the raw materials of the core components are aggregated.

In a case where the core component and the shell fine particle are charged at the same time, if the polarity of the shell fine particle is thermodynamically designed so as to have an intermediate polarity between the core component and the medium (for example, water), the shell fine particle is spontaneously attached to the surroundings of the core component. In a case of attaching shell fine particle in water and/or a wet medium such as an organic solvent, after the composition of the raw material of the core component is determined (after part or all of the core components are aggregated in the case of aggregating particles smaller than the toner base particles to prepare a toner base particle), the shell fine particle is more preferably added from the viewpoint that the shell fine particles can be arranged on the surface of the core component.

As the composition and preparation method of the shell fine particles, those mentioned above can be mentioned. The addition may be performed once or plural times. The first shell fine particles and the next and subsequent shell fine particles may be different or in any combination. In order to increase the stability of the particle agglomerate obtained in the aggregation step, it is preferable to perform fusion within the aggregated particles in the aging step after the aggregation step. The time required for the aging step varies depending on the shape of the toner base particle, but is preferably 0.1 to 10 hours and is particularly preferably 0.5 to 5 hours after reaching Tg of the primary polymer particle after the temperature reaches equal to or greater than Tg of the primary polymer particle.

After the aggregation step, it is preferable that the surfactant is added, pH is adjusted, or both operations are performed together before the aging step or during the aging step. As the surfactant used here, it is possible to use one or more kinds selected from the emulsifier which can be used in the preparing of the primary polymer particle, and particularly it is preferable to use the same one as the emulsifier used in the preparing of the primary polymer particle.

The additional amount in the case of adding the surfactant is not limited, and is preferably equal to or greater than 0.1 parts by mass, and is more preferably equal to or greater than 0.3 parts by mass, and is preferably equal to or less than 20 parts by mass, is more preferably equal to or less than 15 parts by mass, and is still more preferably equal to or less than 10 parts by mass, with respect to 100 parts by mass of the solid component of the mixed dispersion.

By adding a surfactant or adjusting the pH after the aggregation step or before completion of the aging step, it is possible to suppress the aggregation of the particle agglomerate or the like obtained in the aggregation step, and coarse particle generation after the aging step may be suppressed in some cases.

By controlling the time for the aging step, it is possible to prepare a toner base particle having various shapes depending on the purpose, such as a grape type in which the polymer primary particles are aggregated, a potato type in which fusion has advanced, and a spherical shape in which fusion has further progressed.

3.1.2. Method of Preparing Particle Having Toner Base Particle Size by Pulverization It is possible to use a method of obtaining the toner base particle by mixing the respective raw materials, finely pulverizing the mixture to the size of the toner base particle, and adding the shell fine particle before and after finely pulverizing the mixture.

3.1.2.1. Method of Preparing Toner Base Particle by Suspension Polymerization

A colorant, a polymerization initiator, and, if necessary, wax, a polar resin, a charge control agent, a crosslinking agent, and the like are added to the "styrene or (meth)acrylic monomer" which is the same as the above-described monomer composition so as to prepare a monomer composition which is uniformly dissolved or dispersed. If necessary, this monomer composition is dispersed in an aqueous medium containing a suspension stabilizer or the like. The particles are granulated by adjusting the stirring speed and time so that droplets of the monomer composition have a desired size of the toner base particle. Thereafter, the stirring is performed to such an extent that the particle state is maintained by the action of the dispersion stabilizer and precipitation of the particles is prevented, and polymerization is performed, and thereby the toner base particle can be obtained.

Specific examples of the suspension stabilizer include calcium phosphate, magnesium phosphate, calcium hydroxide, and magnesium hydroxide. These may be used alone or two or more kinds thereof may be used in combination, and the amount thereof is preferably 1 part by mass to 10 parts by mass with respect to 100 parts by mass of the polymerizable monomer. These suspension stabilizers may be added to the polymerization system before, simultaneously with, or after the addition of the polymerizable monomer, and these addition methods may be combined if necessary.

In a case where the polar resin such as a polyester resin and a carboxyl group containing styrene resin is contained in the monomer composition, the polar resin tends to be transferred to the vicinity of the droplet surface after forming the droplet by dispersing the monomer composition in the aqueous medium. When the polymerization is performed in this state, the toner base particle having different compositions on the inside and on the surface can be obtained. For example, when a polar resin having Tg higher than Tg after polymerization of the monomer is selected, a structure in which the Tg is low in the inside of the toner base particle and the resin having high Tg is present on the surface at a high ratio can be obtained. In the present invention, the blocking resistance of the obtained toner is enhanced by coating the shell particles on the core component. Here, when this method is used in combination, excellent blocking resistance is more easily obtained.

The shell fine particle may be added at any timing, for example, the polarity of the shell fine particles can be designed by dissolving the shell fine particle in the monomer composition and thereafter, dispersing the shell fine particle in the aqueous medium such that the shell fine particles comes to the interface between the core component and water. Further, the shell fine particle may be added after the monomer composition of the core component is dispersed, or the shell fine particles may be added after the monomer composition of the core component is dispersed and partially or almost all of the polymerizable monomers of the core component are polymerized. In view of disposing the shell fine particles on the surface of the core component, it is preferable to add the shell fine particle after polymerizing a part of the polymerizable monomer, and it is more preferable to add the shell fine particles after substantially all of the polymerizable monomers are polymerized.

As the composition and preparation method of the shell fine particles, those mentioned above can be mentioned. The addition may be performed once or plural times. The first shell fine particles and the next and subsequent shell fine particles may be different or in any combination. Besides, a pH adjusting agent, a polymerization degree adjusting agent, a defoaming agent, and the like can be appropriately added to the reaction system.

3.1.2.2. Method of Preparing Toner Base Particles by Dissolution Suspension

An oily dispersion in which at least a binder resin and a colorant, if necessary, wax, a charge control agent, and the like are dissolved or dispersed in an organic solvent is prepared and dispersed in an aqueous medium. Thereafter, the toner base particle can be obtained by removing the organic solvent from the dispersion. The shell fine particle may be added in advance to the oily dispersion, or may be added after being dispersed in the aqueous medium, or may be added after removing the organic solvent.

As the composition and preparation method of the shell fine particles, those mentioned above can be mentioned. The addition of the shell fine particle may be performed once or plural times. The first shell fine particles and the next and subsequent shell fine particles may be different or in any combination.

As the aqueous medium, water may be used alone, and a solvent miscible with water can be used in combination.

As necessary, a dispersant can be used. It is preferable to use a dispersant from the aspect that the particle size distribution becomes sharp and dispersion is stabilized. As the dispersant, the same emulsifiers as used in the above-described emulsion polymerization can be used. Further, various types of hydrophilic polymeric substances that form polymeric protective colloids in the aqueous medium can be present.

In addition, it is possible to use inorganic fine particles and/or polymer fine particles to control the particle diameter. As the inorganic fine particles, various known inorganic compounds which are insoluble or hardly soluble in water are used. Examples of such materials include tricalcium phosphate, calcium carbonate, titanium oxide, colloidal silica, and hydroxyapatite. Here, the polymer fine particle may be regarded as the shell fine particle.

In the case of dispersing the oily dispersion in the aqueous medium, a known dispersing machine such as a low speed shearing type, a high speed shearing type, a friction type, a high pressure jet type, and an ultrasonic wave can be applied as a dispersion apparatus. Instead of the binder resin, a prepolymer having a reactive group may be used so as to prepare the oily dispersion, and the oily dispersion is dispersed in the aqueous medium, followed by reacting the reactive group to elongate the resin. In this method, since the prepolymer has a relatively low molecular weight, the viscosity of the oily dispersion is difficult to be increased and the dispersion is easily dispersed in the aqueous medium. In order to facilitate uniform dispersion of the colorant in the oily dispersion liquid, the colorant may be prepared as a master batch in which the colorant is composited with the resin in advance, and this may be dispersed in an organic solvent. As a method for removing the organic solvent, there is a method of volatilizing the organic solvent while reducing the pressure at normal temperature or under heating.

When a resin having high polarity and a resin having low polarity are used in combination as a binder resin, droplets are formed by dispersing the monomer composition in the aqueous medium, and then the resin having high polarity is formed in the vicinity of the droplet surface, and the resin having low polarity moves to the vicinity of the center of the droplet. When the organic solvent is removed thereafter, the toner base particle having different compositions on the inside and on the surface can be obtained. In a case of preparing the oily dispersion with the prepolymer capable of reacting with an active hydrogen group-containing compound, after dispersing the oily dispersion in the aqueous medium, the active hydrogen group-containing compound is added, elongating reaction or crosslinking reaction is performed on both of the oily dispersion and the active hydrogen group-containing compound from the droplet surface in the aqueous medium, and thereby an elongated or crosslinked resin is preferentially formed on the droplet surface. When the organic solvent is removed thereafter, the toner base particle having different compositions on the inside and on the surface can be obtained.

By selecting the raw materials in consideration of Tg of the obtained resin by these methods, a structure having a higher ratio of the resin having a higher Tg on the surface than the inside of the toner base particle can be obtained. In addition, when the polymer fine particle using for the dispersant is regarded as the shell fine particle, and the physical properties of the shell fine particle are adjusted, a structure in which the shell fine particle (polymer fine particle) is present on the surface of the toner base particle.

3.1.3. Washing and Drying of Toner Base Particle

The toner base particles prepared in the above-descried "method of preparing a particle having the size of the toner base particle by aggregating toner base particles smaller than toner base particle", "method of preparing a particle having the size of the toner base particle by suspension polymerization", and "method of preparing toner base particles by dissolution suspension" are separated from the aqueous solvent, washed, dried, and subjected to an externally addition treatment so as to prepare an electrostatic charge image developing toner.

As the liquid used for washing, water is used, but it can also be washed with an aqueous solution of acid or alkali. Also, the washing can be performed with warm water or hot water, and these methods can be used in combination. Through such a washing step, it is possible to reduce and remove the suspension stabilizer, the emulsifier, the unreacted monomer, and the like. In the washing step, it is preferable to repeat an operation of dispersing the toner base particle by forming the toner base particle into a rich slurry or a wet cake shape through, for example, filtration and decantation, and adding a liquid for new washing to the rich slurry or wet cake shaped toner base particle. It is preferable to recover the washed toner base particles in a wet cake form in terms of handling in a subsequent drying step.

In the drying step, a fluidized drying method such as a vibration type flow drying method or a circulation type fluidized drying method, an air stream drying method, a vacuum drying method, a freeze drying method, a spray drying method, a flash jet method, or the like is used. Operating conditions such as the temperature, air volume, and degree of pressure reduction in the drying step are optimized as appropriate based on Tg of the toner particles, a shape, a mechanism, and a size, of an apparatus to be used.

3.1.4. Method of Preparing Toner Base Particle by Melt-Kneading Pulverization Method The melt-kneading pulverization method means a method of obtaining the toner base particle by drying and mixing if necessary a charge control agent, a release agent, a magnetic material, and the like in the binder resin and the colorant, then melt-kneading the mixture with an extruder or the like, and pulverizing and classifying the resultant, in which in the external addition step, after obtaining the toner base particle, the shell fine particle may be added to attached on the surface of the core component.

3.1.5. Addition Timing of Shell Fine Particle

In the case of preparing toner base particle in a wet medium (in water and/or in the organic solvent), as described above, the shell fine particle may be thermodynamically disposed on the surface of the core component and the wet medium by adding (it may be in any state of dissolution, dispersion, and suspension) the shell fine particle together with the core component, or after determining the composition and/or shape of the core component, the shell fine particle may be added such that the shell fine particles are physically cover the surface of the core component in a continuous and/or discontinuous manner.

Further, in the case of preparing the toner base particle in the wet medium (in water and/or the organic solvent), the shell fine particle may be added before and after washing the core component, or the shell fine particle may be added before and after a drying step of the core component. In addition, the shell fine particle may be added in the external addition step, and in the case where the shell fine particle is attached in the external addition step, a method of adding the external additive after adding and fixing the shell fine particle is preferable.

In the melt-kneading pulverization method in which the toner base particle is prepared by the drying method, it is preferable to attach the shell fine particle by adding the shell fine particle before and after the external addition step after pulverizing and classifying. In view of more firmly fixing the core component and the shell fine particle, it is particularly preferable to add the shell fine particle in water and/or the organic solvent.

3.2. Preparing of Toner Satisfying Parameters of Present Invention 3.2.1. Regarding "TP2 (140° C.)/TP1 (140° C.)"

In order to make TP2 (140° C.)/TP1 (140° C.) measured by a rheometer equal to or smaller than 0.95, it is necessary that a shell component is widely present on the surface of the toner base particle such that the outside is covered with the external additive, thereby adjusting the composition such as the molecular weight and the crosslinking density of the binder resin of the core component, and the composition and the amount of the shell fine particle, and in a case of being attached in water, the polar balance between the core component and the shell component is adjusted and then the composition ratio of the whole toner base particles is further adjusted.

In order to make a temperature at which TP2A/TP1A shows a minimum value equal to or greater than 130° C., the composition such as the molecular weight and the crosslinking density of the binder resin of the core component, the composition and the amount of the shell fine particle, and the kind and the amount of the wax are adjusted, and in a case of being attached in water, the polar balance between the core component and the shell component is adjusted and then the composition ratio of the whole toner base particles is further adjusted.

In order to make TP1 (130° C.) equal to or greater than 2.5, the composition such as the molecular weight and the crosslinking density of the binder resin of the core component, the composition and the amount of the shell fine particle, and the kind and the amount of the wax are adjusted.

The volume median diameter of the shell fine particle ($Dv_{50}$) is preferably equal to or larger than 50 nm, and is more preferably equal to or larger than 100 nm, and is preferably equal to or smaller than 350 nm, and is more preferably equal to or smaller than 300 nm. The "volume median diameter ($Dv_{50}$)" in the present invention is defined as a diameter measured by the method described in examples depending on the size of the particle, and as measured as such.

The addition amount of the shell fine particle is preferably 2% by mass to 60% by mass, more preferably 5% by mass to 50% by mass, and particularly preferably 7% by mass to 40% by mass based on 100% by mass when the total amount of solid contents of the shell fine particle and the core component is 100% by mass. The shell component is desired to be disposed in the vicinity of the surface at the time of the toner formation. The shape thereof may be particulate, spherical, or thin film as long as it does not deviate from the present invention.

In order for TP2 (140° C.)/TP1 (140° C.) measured by a rheometer to be adjusted to equal to or smaller than 0.95, it is desirable to combine the compositions so that the binder resin of the core component and the shell component have appropriate compatibility. In the first measurement, the measurement is started in a state in which the binder resin of the core component and the shell component are in contact with each other without being melted. When the first measurement ends, the binder resin of the core component and the shell component are melted with each other by heating at that time. Therefore, in the second measurement, the measurement is started in a state of being melted with each other. This difference appears in the difference between TP2 (140° C.)/TP1 (140° C.). Therefore, the compatibility is adjusted by selecting the kind of the resin contained in the shell component in accordance with the kind of the binder resin of the core component. Hereinafter, the adjusting method will be exemplified, but the numerical values given in the examples are not limited.

That is, it is possible to exemplify a method of making the composition different in such a manner that if the binder resin of the core component is a styrene acrylic resin which is one of poly(meth)acrylic resins, the resin contained in the shell fine particle also becomes the styrene acrylic resin, in a case where the ratio of the styrene monomer to the acrylic monomer in the binder resin of the core component is, for example, 70:30, the ratio of the styrene monomer to the acrylic monomer in the resin contained in the shell fine particle is set to 80:20; in terms of the number of hydrophilic monomers per 100 parts by mass of the other monomers, the resin contained in the shell when the binder resin of the core component is 1 part is set 1.5 times; and a hybrid resin of the styrene acrylic resin and the polyester is used for the binder resin of the core component.

From the aspect that appropriate compatibility between the core component and the shell component can be obtained, a difference between a SP value of the binder resin of the core component and a SP value of the shell fine particle component is preferably 0.1 to 1.1 $cal^{1/2}/cm^{3/2}$, and is more preferably 0.5 to 1.0 $cal^{1/2}/cm^{3/2}$.

In view of increasing the adhesive strength with a recording medium such as paper and decreasing member contamination, it is particularly preferable that there is no shading difference between the core component and the shell component as measured using a transmission electron microscope. The measurement conditions of the transmission electron microscope are measured as described in examples, and the "shading difference" is taken as a "shading difference" when the picture obtained by such a measurement is viewed with the naked eye. Here, the phrase "there is no shading difference" means that there is no difference between the degree of dyeing (degree of black and white) of the core component and the shell component, and an edge of the shell component (that is, a boundary between the core component and the shell component) cannot be seen. However, the above phrase "there is no shading difference" does not exclude an embodiment in which the shading difference is not clear and the shading difference is hardly visible.

It is important to have a certain degree of affinity between the shell fine particle and the core component such that the shell fine particle is not separated from the core component, and thus at least one of the monomer components of the binder resin constituting the core component and at least one of the monomer components constituting the shell fine particle are preferably the same. With such a configuration, the interface between the core component and the shell fine particle becomes seamless and the adhesive strength is increased, so that, for example, the shell is attached to the surface of the core component by a wet method, thereafter, when the shell is stretched in the external addition step, a part of the shell can be anchored to the core component, a portion protruding from the core component can be stretched, the coverage can be increased, and thereby it is possible to obtain a coating form of preferable shell component.

In addition, it is possible to exemplify a method in such a manner that if the binder resin of the core component is the polyester resin, the resin contained in the shell fine particle also becomes the polyester resin, if the acid value of the binder resin is equal to or less than 3 mgKOH/g, the acid value of the resin contained in the shell fine particle is 4 mgKOH/g to 20 mgKOH/g; and the binder resin does not have a hydroxyl group, and the resin contained in the shell fine particle has a hydroxyl group.

When the composition and physical properties of the resin contained in the binder resin of the core component and the shell fine particle are the same as each other, the melting of the binder resin and the shell fine particle progresses when the toner base particle is prepared, and thus TP1 (140° C.) and TP2 (140° C.) measured by a rheometer are almost the same value. Also, when compatibility between the binder resin and the shell fine particle is extremely low, the binder resin and the shell fine particle are not melted to each other by heat in the first measurement, and the structure of the toner is maintained, and thereby TP2 (140° C.) and TP1 (140° C.) have substantially the same value. The shell fine particle contains a resin, but may contain other components such as wax, and a charge control agent.

The number average molecular weight by GPC of the resin contained in the shell fine particle is preferably equal to or greater than 5,000, is more preferably equal to or greater than 8,000, and is still more preferably equal to or greater than 10,000, and is preferably equal to or less than 50,000, is more preferably equal to or less than 40,000, and is still more preferably equal to or less than 35,000. The weight average molecular weight by GPC of the resin contained in the shell fine particle is preferably equal to or greater than 20,000, and is more preferably equal to or greater than 30,000, and is preferably equal to or less than 300,000, and more preferably equal to or less than 200,000.

The Tg of the shell fine particle is preferably equal to or higher than 40° C., and is more preferably equal to or higher than 45° C., and is preferably equal to or lower than 90° C., and is more preferably equal to or lower than 70° C. Further, the Tg of the shell fine particle is preferably higher than the Tg of the binder resin contained in the core component, is more preferably equal to higher than 5° C., and is still more preferably equal to higher than 7° C. Therefore, it is possible to obtain a toner satisfying the range of TP2 (140° C.)/TP1 (140° C.) and TP1 (130° C.). A difference between the Tg of the binder resin contained in the core component and the Tg of the shell fine particle is preferably equal to or lower than 25° C., and is more preferably equal to or lower than 20° C. in view of the excellent fixability at a low temperatures.

In order to adjust TP2 (140° C.)/TP1 (140° C.) measured by a rheometer of the toner to fall within the range of the present invention, the shell fine particle is necessary to be disposed in the vicinity of the surface of the toner base particles. As a composition of the shell fine particle effective for that purpose, it is possible to exemplify a method in such a manner that in a case where preparing the toner base particle in the wet medium (water and/or the organic solvent), it is recommended to make it a composition that is more familiar to the medium than binder resin, for example, in a case where the medium is water, a ratio of an acidic monomer or a basic monomer is higher than the binder resin of the core component, and a content of the acidic monomer or a basic monomer is set to be equal to or greater than 1.0 part by mass with respect to 100 parts by mass of other monomers; and an ionic polymerization initiator is used.

A mass ratio of the binder resin contained in the core component to the resin contained in the shell fine particle (shell resin mass/core resin mass) is preferably equal to or greater than 8/92, more preferably equal to or greater than 15/85, and is preferably equal to or greater than 50/50, and more preferably equal to or greater than 40/60. When the mass ratio is in the above range, the shell layer can be thinly and uniformly formed, and the blocking resistance and the excellent fixability at a low temperature can be realized.

4. External Addition 4.1. External Additive

In the present invention, in order to obtain the physical properties of the electrostatic charge image developing toner of the present invention, to improve the fluidity of the toner, and to improve the charge controllability, an external additive is added. Since the external additive attached to the entire of the surface of the toner base particle, even a portion where the shell component is not present is preferably covered with the external additive. As the external additive, it can be appropriately selected from various inorganic or organic fine particles and used. Two or more kinds of external additives may be used in combination.

Examples of the inorganic fine particle include various carbides such as silicon carbide, boron carbide, titanium carbide, zirconium carbide, hafnium carbide, vanadium carbide, tantalum carbide, niobium carbide, tungsten carbide, chromium carbide, molybdenum carbide, and calcium carbide; various nitrides such as boron nitride, titanium nitride, and zirconium nitride; various borides such as zirconium boride; various oxides such as titanium oxide, calcium oxide, magnesium oxide, zinc oxide, copper oxide, aluminum oxide, cerium oxide, silica, and colloidal silica; various titanic acid compounds such as calcium titanate, magnesium titanate, and strontium titanate; a phosphate compound such as calcium phosphate; sulfide such as molybdenum disulfide; fluoride such as magnesium fluoride, and fluorocarbon; various metal soap such as aluminum stearate, calcium stearate, zinc stearate, and magnesium stearate; talc; bentonite; various carbon blacks; magnetite; and ferrite.

As the organic fine particles, fine particles of a styrene resin, an acrylic resin, an epoxy resin, a melamine resin or the like can be used.

Further, charge stability can be improved by using fluorine atom-containing fine particles.

Among these external additives, particularly, silica, titanium oxide, alumina, zinc oxide, various carbon blacks, conductive carbon black, and the like are suitably used.

As the external additive, those in which the surface of the inorganic fine particle or organic fine particle is subjected to a surface treatment such as hydrophobization with a treating agent such as a silane coupling agent such as hexamethyldisilazane (HMDS) or dimethyldichlorosilane (DMDS), a titanate coupling agent, a silicone oil treatment agent such as silicone oil, dimethyl silicone oil, modified silicone oil, and amino modified silicone oil, silicone varnish, a fluorine-based silane coupling agent, fluorine-based silicone oil, and a coupling agent having an amino group or a quaternary ammonium base. Two or more kinds of these treating agents may be used in combination.

The additional amount of the external additive is preferably equal to or greater than 1.0 parts by mass, and is particularly preferably equal to or greater than 1.5 parts by mass, and is preferably equal to or less than 6.5 parts by mass, and is particularly preferably equal to or less than 5.5 parts by mass, with respect to 100 parts by mass of toner base particle.

In the electrostatic charge image developing toner of the present invention, in view of the charge control, the conductive fine particle may be used as the external additive as well. Examples of the conductive fine particle include metal oxides such as conductive titanium oxide, silica, and magnetite, or those doped with a conductive substance, organic fine particles doped with a conductive substance such as a metal in a polymer having a conjugated double bond such as polyacetylene, polyphenyl acetylene, and poly-p-phenylene, and carbon typified by carbon black and graphite, and the like. Among them, from the viewpoint that conductivity can be imparted without impairing the fluidity of the toner, conductive titanium oxide or the metal oxides and the organic fine particles doped with the conductive substance thereof is more preferable.

A lower limit of the content of the conductive fine particle is preferably equal to or greater than 0.05 parts by mass, is more preferably equal to or greater than 0.1 parts by mass, and is particularly preferably equal to or greater than 0.2 parts by mass, with respect to 100 parts by mass of the toner base particle. On the other hand, an upper limit of the content of the conductive fine particle is preferably equal to or less than 3 parts by mass, is more preferably equal to or less than 2 parts by mass, and is particularly preferably equal to or less than 1 part by mass.

4.2. External Addition Method of External Additive

Examples of the method of adding the external additive include a method using a high-speed stirrer such as a Henschel mixer, and a method using an apparatus capable of applying compressive shear stress. The toner can be prepared by a one-step external addition method in which all of the external additives are simultaneously added and externally added to the toner base particle, but can also be prepared by a stepwise external addition method of performing the external addition for each external additive. As a method for preventing the temperature rise during external addition, installing a cooling device in a container, and externally adding the external additive stepwise can be performed.

5. Others

The electrostatic charge image developing toner of the present invention may be used in any form of a two-component type developer using a toner together with a carrier, or a magnetic or nonmagnetic single component type developer not using a carrier. In the case of using the two-component type developer, as the carrier, magnetic substances such as iron powder, magnetite powder, and ferrite powder, or known ones such as those obtained by coating the surface thereof with a resin, and a magnetic carrier can be used. As the coating resin of the resin coating carrier, a styrene resin, an acrylic resin, a styrene acrylic copolymer resin, a silicone resin, a modified silicone resin, a fluororesin, or a mixture thereof, which are generally known, can be used.

EXAMPLES

The invention will be described more specifically with reference to Examples, but the invention is by no means restricted to the following Examples so long as it does not exceed the gist thereof. In the following examples, "parts" means "parts by mass" and "%" means "% by mass".

In the following Examples and Comparative Examples, a volume median diameter, a number medium diameter, a particle size distribution ($Dv_{50}/Dn_{50}$), an average circularity, a number average molecular weight (Mn), a weight average molecular weight (Mw), an emulsion solid content concentration, and the like were measured as follows. In the present invention, each numerical value is defined as measured as follows.

<Volume Median Diameter Measurement 1>

A volume median diameter ($Dv_{50}$) of a particle having a volume median diameter of less than 1 μm was measured by the method described in the handling manual using Microtrac Nanotrac 150 (hereinafter abbreviated as "Nanotrac") manufactured by Nikkiso Co., Ltd., and the analysis soft Microtrac Particle Analyzer Ver 10.1.2-019EE manufactured by the same company under the conditions of ion-exchanged water having electric conductivity of 0.5 μS/cm as a solvent, refractive index of solvent: 1.333, measuring time: 120 seconds, number of measuring times: 5, and the average value was calculated. Other setting conditions were refractive index of particles: 1.59, permeability: permeable, shape: spherical shape, and density: 1.04.

<Volume Median Diameter Measurement 2>

The volume median diameter ($Dv_{50}$) and the number median diameter ($Dn_{50}$) of the particle having a volume median diameter equal to or larger than 1 μm was measured by means of Multisizer III (aperture diameter: 100 μm) (hereinafter abbreviated as "Multisizer") manufactured by Beckman Coulter, Inc., using, as a dispersion medium, Isoton II manufactured by the same company and dispersing the toner particles so that the dispersoid concentration became 0.03% by mass. The particle size distribution is a value obtained by dividing $Dv_{50}$ by $Dn_{50}$.

<Average Circularity>

The average circularity was measured by dispersing dispersoids in a dispersion medium (cell sheath: manufactured by Sysmex Corporation) so that its concentration fell within a range of 5,720 to 7,140 particles/μL by using a flow-type particle image analyzer (FPIA3000, manufactured by Sysmex Corporation) under conditions of HPF analytical amount of 0.35 μL and the number of pieces on HPF detection of 2000 to 2500 in HPF mode.

<Number Average Molecular Weight (Mn), Weight Average Molecular Weight (Mw)>

THF soluble components of the primary polymer particle dispersion were measured by gel permeation chromatography (GPC) under the following conditions.

Apparatus: GPC apparatus manufactured by Tosoh Corporation HLC-8320, Column: TOSOH TSKgel Super HM-H (diameter of 6 mm×length of 150 mm×two), Solvent: THF, Column temperature: 40° C., Flow rate: 0.5 mL/min, Sample concentration: 0.1% by mass, Calibration curve: standard polystyrene <Emulsion Solid Content Concentration>

The emulsion solid content concentration was obtained by heating 2 g of sample at 195° C. for 90 minutes using an infrared moisture meter FD-610 manufactured by Kett Electric Laboratory, so as to evaporate moisture.

<Tg (Glass Transition Temperature)>

Tg measurement by differential scanning calorimeter (DSC) was performed as follows using Q20 manufactured by TA Instruments. 3±1 mg of sample was put into an aluminum pan and precisely weighed to a 0.1 mg digit, an aluminum pan filled with 3 mg of aluminum oxide was used as a reference, and the temperature was raised from 0° C. to 120° C. at a rate of 10° C./min in a nitrogen stream. After holding at 120° C. for 10 minutes, the temperature was cooled to 0° C. at 10° C./min, kept for 5 minutes, and then again raised to 120° C. at 10° C./min. The temperature at an intersection of a baseline before the endothermic peak at the second temperature rise and a tangent at the first inflection point appearing at 30° C. to 60° C. after starting of the endothermic peak was set as Tg. In a case where the sample was an aqueous dispersion, Tg was measured by the above method after freeze-drying to remove moisture.

<Storage Modulus G' (120° C.)>

G' at 120° C. measured by rheometer was obtained by the following procedure. Measurement was carried out by the following using rheometer ARES (measurement control software TA Orchestrator V 7.2.0.2) manufactured by TA Instruments. Approximately 1.3 g of sample was placed in a jig for 20 mm diameter and pressed with a gauge of 30 kg/cm$^2$ for 10 minutes with a press machine (5 ton press PE-5Y, manufactured by Kodaira Seisakusho Co., Ltd.) which was heated to 50° C., and molded into a pellet. A pellet was set to a measurement apparatus on which a circular parallel plate having a diameter of 25 mm was mounted and the temperature was set to 40° C., and the temperature was raised to 120° C. The upper plate was lowered and to the jig. Then, the temperature was rapidly cooled to 40° C. Then, G' was measured under the following conditions, G' at 120° C. was determined from the obtained G'.

Measurement frequency 'Frequency' 6.28 rad/sec
Initial temperature 'Initial Temp.' 40.0° C.
Final temperature 'Final Temp.' 165.0° C.
Heating rate 'Ramp Rate' 4.0° C./min
Retention time after temperature rise 'Soak Time After Ramp' 20 s (second)
Measurement cycle time 'Time Per Measure' 1 s (second)
Distortion 'Strain' 0.1%

<Softening Point>

The softening point measured by a rheometer was obtained by the following procedure. Measurement was carried out by the following method using flow tester CFT-500D manufactured by Shimadzu Corporation. About 1.0 g of the sample was pressed by a press and molded into pellets. The temperature was raised from 60° C. at 6° C./min under conditions of a die diameter of 1 mm, a die length of 1 mm, and a load of 20 kg. The temperature at a midpoint from the start of sample outflow to the end of sample outflow was taken as the softening point.

<Preparation of Wax Dispersion A1: Emulsification Step>

30.00 parts (1440 g) of ester wax 1 as wax (prepared by NOF CORPORATION, Product name: WEP-3, second measurement melting point peak of Tg measurement by DSC: 71.0° C., second measurement onset temperature of Tg measurement by DSC: 68.6° C., second measurement inflection point of Tg measurement by DSC: 69.9° C., Catalog acid value: 0.1 mgKOH/g, Catalog hydroxyl value: equal to or lower than 3 mgKOH/g), 0.24 part of decaglycerin decabenate (prepared by Mitsubishi-Chemical Foods Corporation, Product name: B100D, Hydroxyl value: 27, melting point 70° C.), 1.93 parts of 20% aqueous sodium dodecyl benzene sulfonate solution (hereinafter, abbreviated as "20% DBS aqueous solution"), and 67.83 parts of demineralized water were heated at 90° C., and mixed in a CSTR type stirring layer equipped with a 45° inclined three-stage paddle blade for 20 minutes.

Subsequently, circulating emulsification was started under a pressure condition of 25 MPa using a valve homogenizer (manufactured by Gaulin, 15-M-8 PA type) while heating the dispersion at 90° C., and the particle diameter was measured with a Nanotrac, and dispersed until the volume median diameter reached 245 nm so as to prepare a wax dispersion A1 (emulsion solid content concentration=31.2%, wax component concentration 30.8%).

<Preparation of Wax Dispersion A2: Emulsification Step>

27.30 parts of paraffin wax 1 as wax (prepared by NIPPON SEIRO CO., LTD., Product name: HNP-9, Catalog melting point: 75° C.), 2.70 parts of stearylacrylate (prepared by TOHO Chemical Industry Co., Ltd., Product name: ST-A), 1.93 parts of 20% aqueous DBS solution, and 68.07 parts of demineralized water were heated at 90° C., and mixed in a CSTR type stirring layer equipped with a 45° inclined three-stage paddle blade for 20 minutes.

Subsequently, circulating emulsification was started under a pressure condition of 25 MPa using a valve homogenizer (manufactured by Gaulin, 15-M-8 PA type) while heating the dispersion at 90° C., and the particle diameter was measured with a Nanotrac, and dispersed until the volume median diameter reached 260 nm so as to prepare a wax dispersion A2 (emulsion solid content concentration=30.2%, wax component concentration 29.8%).

<Preparation of Wax Dispersion A3: Emulsification Step>

30.00 parts of ester wax 2 as wax (prepared by NOF CORPORATION, Product name: Unistar H-476, melting point: 62° C.), 2A8 parts of 20% aqueous DBS solution, and 67.52 parts of demineralized water were heated at 85° C., and mixed in a CSTR type stirring layer equipped with a 45° inclined three-stage paddle blade for 20 minutes. Subsequently, circulating emulsification was started under a pressure condition of 20 MPa using a valve homogenizer (manufactured by Gaulin, 15-M-8 PA type) while heating the dispersion at 85° C., and the particle diameter was measured with a Nanotrac, and dispersed until the volume median diameter reached 246 nm so as to prepare a wax dispersion A3 (emulsion solid content concentration=30.1%, wax component concentration 29.5%).

<Preparation of Wax Dispersion A4: Emulsification Step>

As raw materials, 22.50 parts of the above-described ester wax 1, 7.50 parts (1080 g) of ester wax 3 (prepared by NOF CORPORATION, Product name: WEP-5, Catalog melting point: 82° C., Catalog acid value: 0.1 mgKOH/g, Catalog hydroxyl value: equal to or lower than 3 mgKOH/g), 0.24 parts of decaglycerin decabenate, 1.93 parts of 20% DBS aqueous solution, and 67.83 parts of demineralized water were used so as to prepare a wax dispersion A4 (emulsion solid content concentration=31.4%, wax component concentration 31.0%) by using the same method used in the case of the wax dispersion A1.

<Preparation of wax dispersion A5: Emulsification Step>

27.0 parts of alkyl modified silicone wax having the following structure (1) as was (surface tension 27 mN/m, melting point 63° C., melting heat 97 J/g, melting peak half-value width 10.9° C., crystallization peak half width 17.0° C.), 0.3 part of anionic surfactant (prepared by DKS Co. Ltd., Neogen S.C.), and 73.0 parts of demineralized water were heated at 90° C., and mixed in a CSTR type stirring layer equipped with a 45° inclined three-stage paddle blade for 10 minutes.

Subsequently, circulating emulsification was started under a pressure condition of 20 MPa using a valve homogenizer (manufactured by Gaulin, 15-M-8 PA type) while heating the dispersion at 90° C., and the particle diameter was measured with a Nanotrac, and dispersed until the volume median diameter reached 246 nm so as to prepare a wax dispersion A5 (emulsion solid content concentration=27.1%, wax component concentration 26.9%).

[Chem.1]

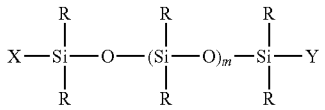

(1)

(In formula (1), R=methyl group, m=10, X=Y=an alkyl group having an average carbon number of 30)

<Preparing of Primary Polymer Particle B1: Polymerization Step>

10.8 parts (as a wax component) of the wax dispersion A1, 256 parts of demineralized water, and 0.02 part of 0.5% iron sulfate (II) heptahydrate aqueous solution were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers and emulsifier aqueous solution which had previously been stirred with a homogenizer for 30 minutes was added for 240 minutes. The time at which the mixture of the following monomers and emulsifier aqueous solution was started to add was taken as the polymerization initiation, and the following initiator aqueous solution was added for 480 minutes from 0 minute of the initiation of polymerization. The following iron sulfate aqueous solution was added at 240 minute after the initiation of polymerization. The temperature was raised to 95° C. at 300 minutes after the initiation of polymerization. Heating and stirring was continued until 540 minutes after the initiation of polymerization.

[Monomers]
Styrene: 72.7 parts
Butyl acrylate: 27.3 parts
Acrylic acid: 0.95 part
Trichlorobromomethane: 1.43 parts
Hexanediol diacrylate: 1.41 parts
[Aqueous Solution of Emulsifier]
20% DBS aqueous solution: 1.0 part
Demineralized water: 67.2 parts
[Initiator Aqueous Solution]
8% aqueous hydrogen peroxide solution: 28.0 parts
8% L-(+) ascorbic acid aqueous solution: 28.0 parts
[Iron Sulfate Aqueous Solution]
0.5% iron sulfate (II) heptahydrate aqueous solution: 0.08 part After 540 minutes from the initiation of polymerization, the temperature was cooled to 30° C., and a milky white primary polymer particle B1 was obtained. The volume median diameter measured by using the Nanotrac was 243 nm. The number average molecular weight (Mn) was 13,000, and the weight average molecular weight (Mw) was 102,000. The solid content concentration was 23.7% by mass, and Tg was 40° C.

<Preparing of Primary Polymer Particle B2: Polymerization Step>

10.5 parts (as a wax component) of the wax dispersion A2, 282 parts of demineralized water and 0.02 part of 0.5% iron sulfate (II) heptahydrate aqueous solution were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers, emulsifier aqueous solution, and iron sulfate aqueous solution which had previously been stirred with a homogenizer for 30 minutes was added for 300 minutes. The time at which the mixture of the following monomers, emulsifier aqueous solution, and iron sulfate aqueous solution was started to added was taken as the polymerization initiation, and the following initiator aqueous solution 1 was added for 270 minutes from 30 minute of the initiation of polymerization. Then, the following initiator aqueous solution 2 was continuously added for 120 minutes from 300 minutes after the initiation of polymerization. Heating and stirring was continued until 540 minutes after the initiation of polymerization.

[Monomers]
Styrene: 76.8 parts
Butyl acrylate: 23.2 parts
Acrylic acid: 1.50 parts
Trichlorobromomethane: 1.00 part
Hexanediol diacrylate: 0.70 part
[Aqueous Solution of Emulsifier]
20% DBS aqueous solution: 1.0 part
Demineralized water: 67.1 parts
[Initiator Aqueous Solution 1]
8% aqueous hydrogen peroxide solution: 15.5 parts
8% L-(+) ascorbic acid aqueous solution: 15.5 parts
[Initiator Aqueous Solution 2]
8% aqueous hydrogen peroxide solution: 0.00 part
8% L-(+) ascorbic acid aqueous solution: 14.7 parts
[Iron Sulfate Aqueous Solution]
0.5% iron sulfate (II) heptahydrate aqueous solution: 0.02 part After 540 minutes from the initiation of polymerization, the temperature was cooled to 30° C., and a milky white primary polymer particle B2 was obtained. The volume median diameter measured by using the Nanotrac was 254 nm. The number average molecular weight (Mn) was 16,000, and the weight average molecular weight (Mw) was 88,000. The solid content concentration was 20.6% by mass, and Tg was 51° C.

<Preparing of Primary Polymer Particle B3: Polymerization Step>

12.5 parts (as a wax component) of the wax dispersion A3, 334 parts of demineralized water and 0.02 part of 0.5% iron sulfate (II) heptahydrate aqueous solution were added to a reactor equipped with a stirring device, a heating and cooling device, a concentrating device, and each raw material and auxiliaries charging device, and a temperature in the reactor was raised to 70° C. under a nitrogen stream while stirring.

Thereafter, while continuing the stirring, a mixture of the following monomers, emulsifier aqueous solution, and iron sulfate aqueous solution which had previously been stirred with a homogenizer for 30 minutes was added for 300 minutes.

The time at which the mixture of the following monomers, emulsifier aqueous solution, and iron sulfate aqueous solution was started to added was taken as the polymerization initiation, and the following initiator aqueous solution 1 was added collectively 5 minutes before the initiation of polymerization. Then, the following initiator aqueous solution 2 was continuously added for 300 minutes from 0 minute of the initiation of polymerization. Then, the following initiator aqueous solution 3 was continuously added for 180 minutes from 300 minutes after the initiation of polymerization. The temperature was raised to 90° C. at 300 minutes after the initiation of polymerization. Heating and stirring was continued until 540 minutes after the initiation of polymerization.

[Monomers]
Styrene: 76.9 parts
Butyl acrylate: 23.1 parts
Acrylic acid: 1.50 parts
Trichlorobromomethane: 0.45 part
Hexanediol diacrylate: 1.00 part
[Aqueous Solution of Emulsifier]
20% DBS aqueous solution: 0.9 part
Demineralized water: 67.4 parts

[Initiator Aqueous Solution 1]
8% aqueous hydrogen peroxide solution: 3.2 parts
8% L-(+) ascorbic acid aqueous solution: 3.2 parts
[Initiator Aqueous Solution 2]
8% aqueous hydrogen peroxide solution: 14.0 parts
8% L-(+) ascorbic acid aqueous solution: 14.0 parts
[Initiator Aqueous Solution 3]
8% aqueous hydrogen peroxide solution: 9.31 parts
8% L-(+) ascorbic acid aqueous solution: 9.31 parts
[Iron Sulfate Aqueous Solution]
0.5% iron sulfate (II) heptahydrate aqueous solution: 0.01 part After 540 minutes from the initiation of polymerization, the temperature was cooled to 30° C., and a milky white primary polymer particle B3 was obtained. The volume median diameter measured by using the Nanotrac was 190 nm. The number average molecular weight (Mn) was 30,000, and the weight average molecular weight (Mw) was 141,000. The solid content concentration was 18.8% by mass.

<Preparing of Primary Polymer Particle B4: Polymerization Step>

10.7 parts (as a wax component) of the wax dispersion A1, 253 parts of demineralized water and 0.02 part of 0.5% iron sulfate (II) heptahydrate aqueous solution were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers and emulsifier aqueous solution which had previously been stirred with a homogenizer for 30 minutes was added for 240 minutes. The time at which the mixture of the following monomers and emulsifier aqueous solution was started to added was taken as the polymerization initiation, and the following initiator aqueous solution was added for 480 minutes from 0 minute of the initiation of polymerization. The following iron sulfate aqueous solution was added at 240 minute after the initiation of polymerization. The temperature was raised to 95° C. at 300 minutes after the initiation of polymerization. Heating and stirring was continued until 540 minutes after the initiation of polymerization.

[Monomers]
Styrene: 70.9 parts
Butyl acrylate: 29.1 parts
Acrylic acid: 0.85 part
Trichlorobromomethane: 1.00 part
Hexanediol diacrylate: 1.00 part
[Aqueous Solution of Emulsifier]
20% DBS aqueous solution: 1.0 part
Demineralized water: 66.9 parts
[Initiator Aqueous Solution]
8% aqueous hydrogen peroxide solution: 28.0 parts
8% L-(+) ascorbic acid aqueous solution: 28.0 parts
[Iron Sulfate Aqueous Solution]
0.5% iron sulfate (II) heptahydrate aqueous solution: 0.08 part After 540 minutes from the initiation of polymerization, the temperature was cooled to 30° C., and a milky white primary polymer particle B4 was obtained. The volume median diameter measured by using the Nanotrac was 245 nm. The number average molecular weight (Mn) was 16,000, and the weight average molecular weight (Mw) was 67,000. The solid content concentration was 23.6% by mass, and Tg was 39° C.

<Preparing of Primary Polymer Particle B5: Polymerization Step>

10.8 parts (as a wax component) of the wax dispersion A1, 255 parts of demineralized water and 0.02 part of 0.5% iron sulfate (II) heptahydrate aqueous solution were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers and emulsifier aqueous solution which had previously been stirred with a homogenizer for 30 minutes was added for 240 minutes. The time at which the mixture of the following monomers and emulsifier aqueous solution was started to added was taken as the polymerization initiation, and the following initiator aqueous solution was added for 480 minutes from 0 minute of the initiation of polymerization. The following iron sulfate aqueous solution was added at 240 minute after the initiation of polymerization. The temperature was raised to 95° C. at 300 minutes after the initiation of polymerization. Heating and stirring was continued until 540 minutes after the initiation of polymerization.

[Monomers]
Styrene: 75.4 parts
Butyl acrylate: 24.6 parts
Acrylic acid: 0.95 part
Trichlorobromomethane: 1.43 parts
Hexanediol diacrylate: 1.505 parts
[Aqueous Solution of Emulsifier]
20% DBS aqueous solution: 1.0 part
Demineralized water: 67.3 parts
[Initiator Aqueous Solution]
8% aqueous hydrogen peroxide solution: 27.9 parts
8% L-(+) ascorbic acid aqueous solution: 27.9 parts
[Iron Sulfate Aqueous Solution]
0.5% iron sulfate (II) heptahydrate aqueous solution: 0.08 part After 540 minutes from the initiation of polymerization, the temperature was cooled to 30° C., and a milky white primary polymer particle B5 was obtained. The volume median diameter measured by using the Nanotrac was 251 nm. The number average molecular weight (Mn) was 13,000, and the weight average molecular weight (Mw) was 72,300. The solid content concentration was 23.7% by mass.

<Preparing of Shell Fine Particle C1: Polymerization Step>

10.5 parts (as a wax component) of the wax dispersion A2, 282 parts of demineralized water and 0.02 part of 0.5% iron sulfate (II) heptahydrate aqueous solution were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers, emulsifier aqueous solution, and iron sulfate aqueous solution which had previously been stirred with a homogenizer for 30 minutes was added for 300 minutes. The time at which the mixture of the following monomers, emulsifier aqueous solution, and iron sulfate aqueous solution was started to added was taken as the polymerization initiation, and the following initiator aqueous solution 1 was added for 270 minutes from 30 minute of the initiation of polymerization. Then, the following initiator aqueous solution 2 was continuously added for 120 minutes from 300 minutes after the initiation of polymerization.

Heating and stirring was continued until 540 minutes after the initiation of polymerization.

[Monomers]
Styrene: 76.8 parts
Butyl acrylate: 23.2 parts
Acrylic acid: 1.50 parts
Trichlorobromomethane: 1.00 part
Hexanediol diacrylate: 0.70 part
[Aqueous Solution of Emulsifier]
20% DBS aqueous solution: 1.0 part
Demineralized water: 67.1 parts
[Initiator Aqueous Solution 1]
8% aqueous hydrogen peroxide solution: 15.5 parts
8% L-(+) ascorbic acid aqueous solution: 15.5 parts
[Initiator Aqueous Solution 2]
8% aqueous hydrogen peroxide solution: 0.00 part
8% L-(+) ascorbic acid aqueous solution: 14.7 parts
[Iron Sulfate Aqueous Solution]
0.5% iron sulfate (II) heptahydrate aqueous solution: 0.02 part After 540 minutes from the initiation of polymerization, the temperature was cooled to 30° C., and a milky white shell fine particle C1 was obtained. The volume median diameter measured by using the Nanotrac was 254 nm. The weight average molecular weight (Mw) was 88,000. The solid content concentration was 20.6% by mass, and Tg was 51° C.

<Preparing of Shell Fine Particle C2: Polymerization Step>

50.6 parts (as a wax component) of the wax dispersion A4, 2.96 parts of 20% DBS aqueous solution, and 350 parts of demineralized water, as an emulsifier (DBS SP) for adjusting particle diameter were added to a reactor equipped with a stirring device, a heating and cooling device, a concentrating device, and each raw material and auxiliaries charging device, and a temperature in the reactor was raised to 75° C. under a nitrogen stream while stirring.

In 5 minutes after adding the following initiator aqueous solution 1, while continuing the stirring, a mixture of the following monomers and emulsifier aqueous solution which had previously been stirred with a homogenizer for 30 minutes was added for 180 minutes. The time at which the mixture of the following monomers and emulsifier aqueous solution was started to added was taken as the polymerization initiation, and the following initiator aqueous solution 2 was continuously added for 60 minutes from 240 minute of the initiation of polymerization. The following initiator aqueous solution 3 was continuously added for 120 minutes from 240 minutes after the initiation of polymerization. The following iron sulfate aqueous solution was added at 180 minute after the initiation of polymerization. The temperature was raised to 93° C. at 180 minutes after the initiation of polymerization. Heating and stirring was continued until 480 minutes after the initiation of polymerization.

[Monomers]
Styrene: 97.9 parts
Butyl acrylate: 2.1 parts
Acrylic acid: 1.5 parts
1-dodecanethiol: 1.0 part
[Aqueous Solution of Emulsifier]
20% DBS aqueous solution: 1.0 part
Demineralized water: 66.7 parts
[Initiator Aqueous Solution 1]
20% ammonium persulfate aqueous solution: 6.0 parts
[Initiator Aqueous Solution 2]
8% aqueous hydrogen peroxide solution: 14.2 parts
[Initiator Aqueous Solution 3]
8% L-(+) ascorbic acid aqueous solution: 21.3 parts
[Iron Sulfate Aqueous Solution]
0.5% iron sulfate (II) heptahydrate aqueous solution: 0.05 part After 480 minutes from the initiation of polymerization, the temperature was cooled to 30° C., and a milky white shell fine particle C2 was obtained. The volume median diameter measured by using the Nanotrac was 158 nm. The weight average molecular weight (Mw) was 59,000. The solid content concentration was 20.0%, and Tg was 80° C.

<Preparing of Shell Fine Particle C3: Polymerization Step>

1.72 parts of 20% DBS aqueous solution, 285 parts of demineralized water, and 0.01 part of 0.5% iron sulfate (II) heptahydrate aqueous solution as an emulsifier (DBS SP) for adjusting particle diameter were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers and emulsifier aqueous solution which had previously been stirred with a homogenizer for 30 minutes was added for 300 minutes. The time at which the mixture of the following monomers and emulsifier aqueous solution was started to added was taken as the polymerization initiation, and the following initiator aqueous solution 1 was added collectively 5 minutes before the initiation of polymerization. Then, the following initiator aqueous solution 2 was continuously added for 300 minutes from 0 minute of the initiation of polymerization. Then, the following initiator aqueous solution 3 was continuously added for 120 minutes from 300 minutes after the initiation of polymerization. The temperature was raised to 95° C. at 300 minutes after the initiation of polymerization. The following iron sulfate aqueous solution was added at 300 minute after initiating polymerization of the iron sulfate aqueous solution. Heating and stirring was continued until 540 minutes after the initiation of polymerization.

[Monomers]
Styrene: 100.0 parts
Butyl acrylate: 0.0 part
Acrylic acid: 0.50 part
Trichlorobromomethane: 0.75 part
Hexanediol diacrylate: 0.00 part
[Aqueous Solution of Emulsifier]
20% DBS aqueous solution: 1.0 part
Demineralized water: 66.0 parts
[Initiator Aqueous Solution 1]
8% aqueous hydrogen peroxide solution: 3.2 parts
8% L-(+) ascorbic acid aqueous solution: 3.2 parts
[Initiator Aqueous Solution 2]
8% aqueous hydrogen peroxide solution: 15.7 parts
8% L-(+) ascorbic acid aqueous solution: 15.7 parts
[Initiator Aqueous Solution 3]
8% aqueous hydrogen peroxide solution: 0.00 part
8% L-(+) ascorbic acid aqueous solution: 14.2 parts
[Iron Sulfate Aqueous Solution]
0.5% iron sulfate (II) heptahydrate aqueous solution: 0.05 part After 540 minutes from the initiation of polymerization, the temperature was cooled to 30° C., and a milky white shell fine particle C3 was obtained. The volume median diameter measured by using the Nanotrac was 141 nm. The weight average molecular weight (Mw) was 63,000. The solid content concentration was 19.9% by mass.

<Preparing of Shell Fine Particle C4: Polymerization Step>

1.72 parts of 20% DBS aqueous solution, 304 parts of demineralized water, and 0.004 part of 0.5% iron sulfate (II)

heptahydrate aqueous solution as an emulsifier (DBS SP) for adjusting particle diameter were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers, emulsifier aqueous solution, and iron sulfate aqueous solution which had previously been stirred with a homogenizer for 30 minutes was added for 300 minutes. The time at which the mixture of the following monomers, emulsifier aqueous solution, and iron sulfate aqueous solution was started to added was taken as the polymerization initiation, and the following initiator aqueous solution 1 was added collectively 5 minutes before the initiation of polymerization. Then, the following initiator aqueous solution 2 was continuously added for 300 minutes from 0 minute of the initiation of polymerization. Then, the following initiator aqueous solution 3 was continuously added for 120 minutes from 300 minutes after the initiation of polymerization. Heating and stirring was continued until 480 minutes after the initiation of polymerization.

[Monomers]
Styrene: 88.0 parts
Butyl acrylate: 12.0 parts
Acrylic acid: 1.50 parts
Trichlorobromomethane: 0.48 part
Hexanediol diacrylate: 0.40 part
[Aqueous Solution of Emulsifier]
20% DBS aqueous solution: 1.5 parts
Demineralized water: 66.4 parts
[Initiator Aqueous Solution 1]
8% aqueous hydrogen peroxide solution: 3.2 parts
8% L-(+) ascorbic acid aqueous solution: 3.2 parts
[Initiator Aqueous Solution 2]
8% aqueous hydrogen peroxide solution: 15.7 parts
8% L-(+) ascorbic acid aqueous solution: 15.7 parts
[Initiator Aqueous Solution 3]
8% aqueous hydrogen peroxide solution: 0.00 part
8% L-(+) ascorbic acid aqueous solution: 14.2 parts
[Iron Sulfate Aqueous Solution]
0.5% iron sulfate (II) heptahydrate aqueous solution: 0.004 part After 480 minutes from the initiation of polymerization, the temperature was cooled to 30° C., and a milky white shell fine particle C4 was obtained. The volume median diameter measured by using the Nanotrac was 118 nm. The weight average molecular weight (Mw) was 102,000. The solid content concentration was 18.9% by mass.

<Preparing of shell fine particle C5: polymerization step>

5.9 parts (as a wax component) of the wax dispersion A5 and 323 parts of demineralized water were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers and emulsifier aqueous solution which had previously been stirred with a homogenizer for 30 minutes was added for 300 minutes. The time at which the mixture of the following monomers and emulsifier aqueous solution was started to added was taken as the polymerization initiation, and the following initiator aqueous solution 1 was added collectively 5 minutes before the initiation of polymerization. Then, the following initiator aqueous solution 2 was continuously added for 360 minutes from 0 minute after the initiation of polymerization. Heating and stirring was continued until 420 minutes after the initiation of polymerization.

[Monomers]
Styrene: 92.5 parts
Butyl acrylate: 7.5 parts
Acrylic acid: 1.50 parts
Trichlorobromomethane: 0.50 part
Hexanediol diacrylate: 0.00 part
[Aqueous Solution of Emulsifier]
20% DBS aqueous solution: 0.7 part
Demineralized water: 67.0 parts
[Initiator Aqueous Solution 1]
8% aqueous hydrogen peroxide solution: 3.2 parts
8% L-(+) ascorbic acid aqueous solution: 3.2 parts
[Initiator Aqueous Solution 2]
8% aqueous hydrogen peroxide solution: 18.9 parts
8% L-(+) ascorbic acid aqueous solution: 18.9 parts After 420 minutes from the initiation of polymerization, the temperature was cooled to 30° C., and a milky white shell fine particle C5 was obtained. The volume median diameter measured by using the Nanotrac was 283 nm. The weight average molecular weight (Mw) was 74,000. The solid content concentration was 19.6% by mass.

Example 1

<Preparing of Toner Base Particle Dispersion 1: Aggregation Step>

The obtained 60.9 parts (solid content) of primary polymer particle B 1, 0.12 part (solid content) of 20% DBS aqueous solution, 19 parts of deionized water, 0.53 part (solid content) of 5% iron sulfate (II) heptahydrate aqueous solution, and 24 parts of cyan colorant EP-700 (prepared by Dainichiseika Color & Chemicals Mfg. Co., Ltd.) were sequentially added to a reactor equipped with a stirring device, a heating and cooling device, and each raw material and auxiliaries charging device while stirring and mixed homogeneously.

Thereafter, 41 parts of deionized water was added for 6 minutes. Subsequently, the internal temperature was raised to 40° C., and the temperature was raised stepwise until the volume median diameter became 4.9 μm. This temperature (primary aggregation temperature) was 40° C.

Promptly, lowering the temperature was rapidly lowered by 2° C. from the primary aggregation temperature and simultaneously adding 6.8 parts (solid content) of primary polymer particle B1. After 90 minutes, 32.3 parts (solid content) of the shell fine particle C1 was added. After 60 minutes, 4.0 parts (solid content) of 20% DBS aqueous solution and 23 parts of deionized water were added, then the temperature was raised up to 77° C. for 80 minutes, and thereafter, the temperature was raised stepwise until the circularity became 0.966. The temperature (final circulation temperature) when the circularity reached 0.966 was 80° C. Then, the temperature was rapidly cooled to 30° C., and thereby a toner base particle dispersion 1 was obtained.

<Preparing of Toner Base Particle 1: Washing and Drying Step>

The obtained toner base particle dispersion was extracted and suction filtered with an aspirator using filter paper of 5 type C (No. 5C, manufactured by Toyo Roshi Kaisha, Ltd.). The cake remaining on the filter paper was transferred to a stainless steel container equipped with a stirrer (propeller blade), and ion-exchanged water having an electric conductivity of 1 μS/cm was added and dispersed uniformly, followed by stirring for 30 minutes. After this step was repeated until the electric conductivity of the filtrate reached 2 μS/cm, the obtained cake was dried in an air dryer set at 40° C. for 48 hours so as to obtain a toner base particle 1.

<Preparing of Toner 1: External Addition Step>

The following external additives W to Z were used in the external addition step of externally adding to the toner base particle 1.

External additive W: silica particle (BET: 67 $m^2/g$)

External additive X: positively charging silica particle (BET: 119 $m^2/g$)

External additive Y: composite oxide particle (BET: 56 $m^2/g$)

External additive Z: silica particle having large particle diameter (BET: 37 $m^2/g$)

A sample mill (manufactured by Kyoritsu Riko Co., Ltd.) was preheated to 30° C. 0.45 part of the external additive W (silica particle), 0.15 part of the external additive X (positively charging silica particle), 1.20 parts of the external additive Y (composite oxide particle), and 1.00 part of the external additive Z (silica particle having large particle diameter) with respect to 100 parts of the toner base particle 1 obtained above were added, stirred at 4000 rpm for 11 minutes, mixed, externally added, and sieved to obtain toner 1.

Example 2

<Preparing of Toner Base Particle Dispersion 2: Aggregation Step>

The obtained 72.5 parts (solid content) of primary polymer particle B1, 0.12 part (solid content) of 20% DBS aqueous solution, 19 parts of deionized water, 0.53 part (solid content) of 5% iron sulfate (II) heptahydrate aqueous solution, and 24 parts of cyan colorant EP-700 (prepared by Dainichiseika Color & Chemicals Mfg. Co., Ltd.) were sequentially added to a reactor equipped with a stirring device, a heating and cooling device, and each raw material and auxiliaries charging device while stirring and mixed homogeneously. Thereafter, 41 parts of deionized water was added for 6 minutes. Subsequently, the internal temperature was raised to 40° C., and the temperature was raised stepwise until the volume median diameter became 4.9 μm. This temperature (primary aggregation temperature) was 45° C.

Promptly, lowering the temperature was rapidly lowered by 2° C. from the primary aggregation temperature and simultaneously adding 6.8 parts (solid content) of primary polymer particle B1. After 30 minutes, 19.5 parts (solid content) of the shell fine particle C1 was added. After 60 minutes, 4.0 parts (solid content) of 20% DBS aqueous solution and 23 parts of deionized water were added, then the temperature was raised up to 77° C. for 80 minutes, and thereafter, the temperature was raised stepwise until the circularity became 0.966. The temperature (final circulation temperature) when the circularity reached 0.966 was 79° C. Then, the temperature was rapidly cooled to 30° C., and thereby a toner base particle dispersion 2 was obtained.

<Preparing of Toner Base Particle 2: Washing and Drying Step>

A toner base particle 2 was obtained in the same method as the toner base particle 1 except that a toner base particle dispersion 2 was used instead of the toner base particle dispersion 1.

<Preparing of Toner 2: External Addition Step>

A toner 2 was obtained in the same method as the toner 1 except that the toner base particle 2 was used instead of the toner base particle 1.

Comparative Example 1

<Preparing of Toner Base Particle Dispersion 3: Aggregation Step>

The obtained 85.1 parts (solid content) of primary polymer particle B4, 0.26 part (solid content) of 20% DBS aqueous solution, 32 parts of deionized water, 0.52 part (solid content) of 5% iron sulfate (II) heptahydrate aqueous solution, and 18 parts of cyan colorant EP-700 (prepared by Dainichiseika Color & Chemicals Mfg. Co., Ltd.) were sequentially added to a reactor equipped with a stirring device, a heating and cooling device, and each raw material and auxiliaries charging device while stirring and mixed homogeneously. Thereafter, 41 parts of deionized water was added for 6 minutes. Subsequently, the internal temperature was raised to 43° C., and the temperature was raised stepwise until the volume median diameter became 5.2 μm. This temperature (primary aggregation temperature) was 45° C.

Promptly, lowering the temperature was rapidly lowered by 2° C. from the primary aggregation temperature and simultaneously adding 9.5 parts (solid content) of primary polymer particle B4. After 30 minutes, 5.4 parts (solid content) of the shell fine particle C2 was added. After 120 minutes, 4.0 parts (solid content) of 20% DBS aqueous solution and 23 parts of deionized water were added, then the temperature was raised up to 66° C. for 50 minutes, and thereafter, the temperature was raised stepwise until the circularity became 0.976. The temperature (final circulation temperature) when the circularity reached 0.976 was 68° C. Then, the temperature was rapidly cooled to 30° C., and thereby a toner base particle dispersion 3 was obtained.

<Preparing of Toner Base Particle 3: Washing and Drying Step>

A toner base particle 3 was obtained in the same method as the toner base particle 1 except that a toner base particle dispersion 3 was used instead of the toner base particle dispersion 1.

<Preparing of Toner 3: External Addition Step>

A toner 3 was obtained in the same method as the toner 1 except that the toner base particle 3 was used instead of the toner base particle 1.

Comparative Example 2

<Preparing of Toner Base Particle Dispersion 4: Aggregation Step>

The obtained 92.5 parts (solid content) of primary polymer particle B2, 0.07 part (solid content) of 20% DBS aqueous solution, 12 parts of deionized water, 0.58 part (solid content) of 5% iron sulfate (II) heptahydrate aqueous solution, and 16 parts of cyan colorant EP-700 (prepared by Dainichiseika Color & Chemicals Mfg. Co., Ltd.) were sequentially added to a reactor equipped with a stirring device, a heating and cooling device, and each raw material and auxiliaries charging device while stirring and mixed homogeneously. Thereafter, 0.10 part (solid content) of 0.5% aluminum sulfate aqueous solution was added for 10 minutes. Subsequently, the internal temperature was raised to 52° C., and the temperature was raised stepwise until the volume median diameter became 6.0 μm. This temperature (primary aggregation temperature) was 55° C.

Then, 7.5 parts (solid content) of the shell fine particle C3 was added rapidly. After 30 minutes, 6.1 parts (solid content) of 20% DBS aqueous solution and 20 parts of deionized water were added, then the temperature was raised up to 90° C. for 30 minutes, and thereafter, the temperature was raised stepwise until the circularity became 0.980.

The temperature (final circulation temperature) when the circularity reached 0.980 was 99° C. Then, the temperature was rapidly cooled to 30° C., and thereby a toner base particle dispersion 4 was obtained.

<Preparing of Toner Base Particle 4: Washing and Drying Step>

A toner base particle 4 was obtained in the same method as the toner base particle 1 except that a toner base particle dispersion 4 was used instead of the toner base particle dispersion 1.

<Preparing of Toner 4: External Addition Step>

A toner 4 was obtained in the same method as the toner 1 except that the toner base particle 4 was used instead of the toner base particle 1.

Comparative Example 3

<Preparing of Toner Base Particle Dispersion 5: Aggregation Step>

The obtained 95.0 parts (solid content) of primary polymer particle B3, 0.10 part (solid content) of 20% DBS aqueous solution, 59 parts of deionized water, 0.34 part (solid content) of 5% iron sulfate (II) heptahydrate aqueous solution, and 17 parts of cyan colorant EP-700 (prepared by Dainichiseika Color & Chemicals Mfg. Co., Ltd.) were sequentially added to a reactor equipped with a stirring device, a heating and cooling device, and each raw material and auxiliaries charging device while stirring and mixed homogeneously. Thereafter, 0.15 part (solid content) of 0.5% aluminum sulfate aqueous solution was added for 14 minutes, and 15 parts of deionized water was added for 2 minutes. Subsequently, the internal temperature was raised to 51° C., and the temperature was raised stepwise until the volume median diameter became 6.7 μm. This temperature (primary aggregation temperature) was 53° C.

Then, 5.0 parts (solid content) of the shell fine particle C4 was added rapidly. After 30 minutes, 4.8 parts (solid content) of 20% DBS aqueous solution and 12 parts of deionized water were added, then the temperature was raised up to 90° C. for 30 minutes, and thereafter, the temperature was raised stepwise until the circularity became 0.960.

The temperature (final circulation temperature) when the circularity reached 0.960 was 94° C. Then, the temperature was rapidly cooled to 30° C., and thereby a toner base particle dispersion 5 was obtained.

<Preparing of Toner Base Particle 5: Washing and Drying Step>

A toner base particle 5 was obtained in the same method as the toner base particle 1 except that a toner base particle dispersion 5 was used instead of the toner base particle dispersion 1.

<Preparing of Toner 5: External Addition Step>

A toner 5 was obtained in the same method as the toner 1 except that the toner base particle 5 was used instead of the toner base particle 1.

Comparative Example 4

<Preparing of Toner Base Particle Dispersion 6: Aggregation Step>

The obtained 95.0 parts (solid content) of primary polymer particle B2, 0.10 part (solid content) of 20% DBS aqueous solution, 13 parts of deionized water, 0.62 part (solid content) of 5% iron sulfate (II) heptahydrate aqueous solution, and 16 parts of cyan colorant EP-700 (prepared by Dainichiseika Color & Chemicals Mfg. Co., Ltd.) were sequentially added to a reactor equipped with a stirring device, a heating and cooling device, and each raw material and auxiliaries charging device while stirring and mixed homogeneously.

Thereafter, 0.05 part (solid content) of 0.5% aluminum sulfate aqueous solution was added for 5 minutes, and 88 parts of deionized water was added for 11 minutes. Subsequently, the internal temperature was raised to 53° C., and the temperature was raised stepwise until the volume median diameter became 6.4 μm. This temperature (primary aggregation temperature) was 55° C.

Then, 5.0 parts (solid content) of the shell fine particle C5 was added rapidly. After 30 minutes, 6.2 parts (solid content) of 20% DBS aqueous solution and 10 parts of deionized water were added, then the temperature was raised up to 90° C. for 30 minutes, and thereafter, the temperature was raised stepwise until the circularity became 0.960.

The temperature (final circulation temperature) when the circularity reached 0.960 was 98° C. Then, the temperature was rapidly cooled to 30° C., and thereby a toner base particle dispersion 6 was obtained.

<Preparing of Toner Base Particle 6: Washing and Drying Step>

A toner base particle 6 was obtained in the same method as the toner base particle 1 except that a toner base particle dispersion 6 was used instead of the toner base particle dispersion 1.

<Preparing of Toner 6: External Addition Step>

A toner 6 was obtained in the same method as the toner 1 except that the toner base particle 6 was used instead of the toner base particle 1.

Example 3

<Preparing of Toner Base Particle Dispersion 7: Aggregation Step>

The obtained 72.5 parts (solid content) of primary polymer particle B5, 0.02 part (solid content) of 20% DBS aqueous solution, 49 parts of deionized water, 0.49 part (solid content) of 5% iron sulfate (II) heptahydrate aqueous solution, and 24 parts of cyan colorant EP-700 (prepared by Dainichiseika Color & Chemicals Mfg. Co., Ltd.) were sequentially added to a reactor equipped with a stirring device, a heating and cooling device, and each raw material and auxiliaries charging device while stirring and mixed homogeneously. Subsequently, the internal temperature was raised to 45° C., and the temperature was raised stepwise until the volume median diameter became 4.9 μm. This temperature (primary aggregation temperature) was 48° C.

Promptly, lowering the temperature was rapidly lowered by 2° C. from the primary aggregation temperature and simultaneously adding 6.8 parts (solid content) of primary polymer particle B5. After 30 minutes, 32.3 parts (solid content) of the shell fine particle C1 was added. After 60 minutes, 4.0 parts (solid content) of 20% DBS aqueous solution and 23 parts of deionized water were added, then the temperature was raised up to 85° C. for 70 minutes, and thereafter, the temperature was raised stepwise until the circularity became 0.966. The temperature (final circulation temperature) when the circularity reached 0.966 was 85° C.

Then, the temperature was rapidly cooled to 30° C., and thereby a toner base particle dispersion 7 was obtained.

<Preparing of Toner Base Particle 7: Washing and Drying Step>

A toner base particle 7 was obtained in the same method as the toner base particle 1 except that the toner base particle dispersion 7 was used instead of the toner base particle dispersion 1.

<Preparing of Toner 7: External Addition Step>

A toner 7 was obtained in the same method as the toner 1 except that the toner base particle 7 was used instead of the toner base particle 1.

In Examples 1 to 3 and Comparative Examples 1 to 4, the wax kind, the number average molecular weight, and the weight average molecular weight of the primary polymer particle, the volume median diameter and the weight average molecular weight of the shell fine particle, and a primary aggregation temperature and a final circulation temperature in the aggregation step are indicated in Table 1. Further, the volume median diameter ($Dv_{50}$), the number medium diameter (Dn50), the particle size distribution ($Dv_{50}/Dn_{50}$), and the average circularity of the toner to which the toner base particle is externally added are indicated in Table 1.

In Table 1, St means styrene, BA means butyl acrylate, and AA means acrylic acid.

TABLE 1

| | | Polymer primary particle | | | | | | | Shell fine particle | | | |
|---|---|---|---|---|---|---|---|---|---|---|---|---|
| | | Type | St additional amount (part) | BA additional amount (part) | AA additional amount (part) | Wax type | Number average molecular weight | Weight average molecular weight | Type | St additional amount (part) | BA additional amount (part) | AA additional amount (part) |
| Example 1 | Toner 1 | B1 | 72.7 | 27.3 | 0.95 | WEP-3 | 13,000 | 102,000 | C1 | 76.8 | 23.2 | 1.50 |
| Example 2 | Toner 2 | B1 | 72.7 | 27.3 | 0.95 | WEP-3 | 13,000 | 102,000 | C1 | 76.8 | 23.2 | 1.50 |
| Comparative Example 1 | Toner 3 | B4 | 70.9 | 29.1 | 0.85 | WEP-3 | 16,000 | 67,000 | C2 | 97.9 | 2.1 | 1.50 |
| Comparative Example 2 | Toner 4 | B2 | 76.8 | 23.2 | 1.50 | HNP-9 | 16,000 | 88,000 | C3 | 100.0 | 0 | 0.50 |
| Comparative Example 3 | Toner 5 | B3 | 76.9 | 23.1 | 1.50 | H-476 | 30,000 | 141,000 | C4 | 88.0 | 12 | 1.50 |
| Comparative Example 4 | Toner 6 | B2 | 76.8 | 23.2 | 1.50 | HNP-9 | 16,000 | 88,000 | C5 | 92.5 | 7.5 | 1.50 |
| Example 3 | Toner 7 | B5 | 75.4 | 24.6 | 0.95 | WEP-3 | 13,000 | 72,000 | C1 | 76.8 | 23.2 | 1.50 |

| | | Shell fine particle | | Aggregation step | | | Toner shape | | | |
|---|---|---|---|---|---|---|---|---|---|---|
| | | Volume median diameter (nm) | Weight average molecular weight | Additional amount of shell fine particles (part) | Primary aggregation temperature (° C.) | Final circulation temperature (° C.) | Volume median diameter ($Dv_{50}$) (μm) | Number medium diameter ($Dn_{50}$)(μm) | Particle size distribution ($Dv_{50}/Dn_{50}$) | Average circularity |
| Example 1 | Toner 1 | 254 | 88,000 | 32.3 | 40 | 80 | 5.6 | 5.0 | 1.11 | 0.968 |
| Example 2 | Toner 2 | 254 | 88,000 | 19.5 | 45 | 79 | 5.7 | 5.3 | 1.07 | 0.969 |
| Comparative Example 1 | Toner 3 | 158 | 59,000 | 5.4 | 45 | 68 | 5.6 | 5.1 | 1.08 | 0.976 |
| Comparative Example 2 | Toner 4 | 141 | 63,000 | 7.5 | 55 | 99 | 6.3 | 5.9 | 1.07 | 0.978 |
| Comparative Example 3 | Toner 5 | 118 | 102,000 | 5.0 | 53 | 94 | 7.3 | 6.5 | 1.13 | 0.962 |
| Comparative Example 4 | Toner 6 | 283 | 74,000 | 5.0 | 55 | 98 | 6.8 | 6.2 | 1.10 | 0.960 |
| Example 3 | Toner 7 | 254 | 88,000 | 32.3 | 48 | 85 | 5.8 | 5.4 | 1.07 | 0.968 |

By using the toners obtained in Examples 1 to 3 and Comparative Examples 1 to 4, evaluation and determination were performed by the following method. The measured toner (sample) may be an immediately prepared toner, that is, immediately external-added toner, but even with the toner which is aged or already being in the development layer, measured numerical values hardly change, which is common general technical knowledge. Also, a toner after externally added in an environment equal to or higher than 50° C. may not obtain an appropriate value of TP1 in some cases.

[Viscoelasticity]

TP2/TP1 measured by rheometer was obtained by the following procedure.

Measurement was carried out by the following method using rheometer MCR302 manufactured by Anton Paar Japan K.K.

Approximately 1.0 g of sample was placed in a jig for 18 mm diameter and pressed with clamp force of 1.5 ton (gauge of 30 kg/$cm^2$) for 10 minutes with a press machine (5 ton press PE-5Y, manufactured by Kodaira Seisakusho Co., Ltd.) which was heated to 50° C., and molded into a pellet. In the present invention, this may be abbreviated as a "molded body" in some cases.

First temperature rise measurement: A pellet (molded body) was set to a measurement apparatus on which a circular parallel plate having a diameter of 20 mm was mounted, a gap was 5 mm, and the temperature was set to 20° C., and the temperature was set to 120° C. and raised to 120° C. over 4 minutes. After that, the gap was rapidly made 2 mm and was fused to a jig, and trimming (removal of a portion jutting out of the plate) was carried out over about 2 minutes. Then, the temperature was rapidly set to 80° C. and cooled to 80° C. over about 2 minutes. Then, after holding about 2 minutes until the temperature was stable, the temperature was measured under the following conditions. Apparatus: rheometer MCR302 manufactured by Anton Paar Japan K.K.

Temperature control: Upper and lower Peltier temperature control system (P-PTD200+H-PTD200) Nitrogen flow (200 NL/h)

Jig: 20 mm Φ disposable parallel plate

Temperature: temperature rise measurement at 4° C./min from 80° C. to 150° C. (measurement point interval 15 seconds)

Frequency: 1 Hz

Distortion: 0.1%

Gap: 2 mm

Second temperature rise measurement: After the first temperature rise measurement, the temperature was rapidly cooled from 150° C. to 80° C. for about 3 minutes. Then the temperature was held at 80° C. for about 7 minutes. Then measurement was performed rapidly at the second temperature rise under the same condition as the first time.

In addition, since this measurement confirms a difference due to a heat history, it is desirable to use a Peltier temperature control system that enables rapid temperature rise/drop. It is desirable to use toner having no heat history of 50° C. or higher after preparation.

Figure 2:
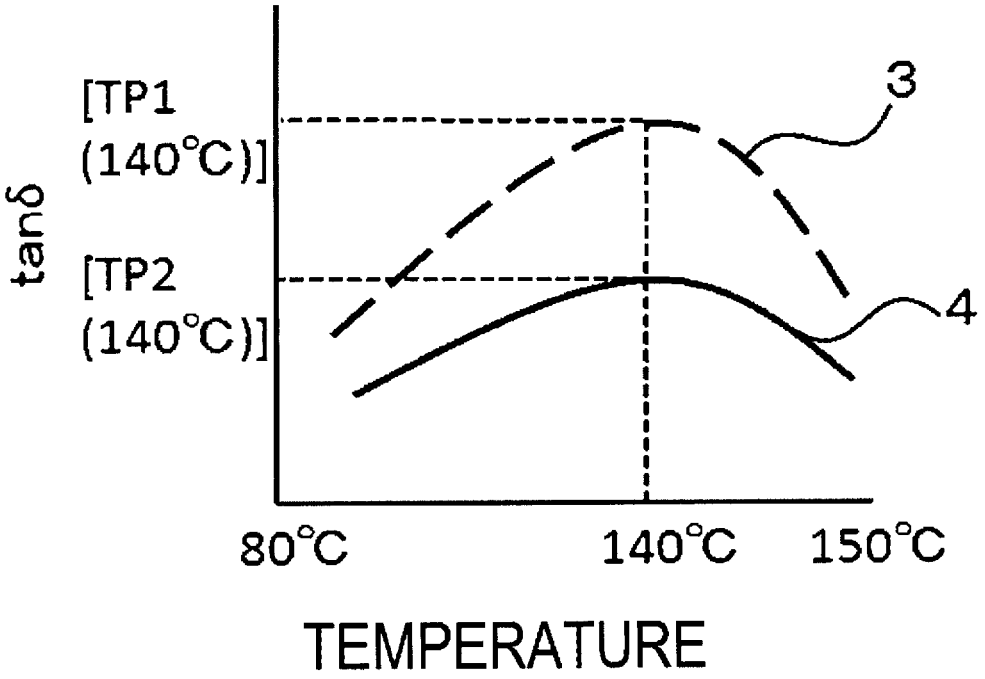
FIG. 2 is a conceptual diagram at the time of measuring TP1 (140° C.) and TP2 (140° C.) of the electrostatic charge image developing toner of the present invention.

The tab δ (that is, loss tangent =G"/G') is obtained by dividing the loss modulus G" obtained in the first temperature rise measurement by the storage modulus G' so as to obtain the TP1 (140° C.) (refer to FIG. 2) of the tan δ appearing at 140° C. Similarly, TP2 (140° C.) (refer to FIG. 2) of the tab δ appearing at 140° C. of the second measurement was obtained, and TP2 (140° C.) was divided by TP1 (140° C.) so as to obtain TP2 (140° C.)/TP1 (140° C.).

Similarly, TP1 (130° C.) of the tab δ appearing at 130° C. of the first measurement was obtained.

Similarly, in a range of 80° C. to 150° C., "TP2A/TP1A minimum temperature", which is a temperature at which TP2A/TP1A shows a minimum value, was obtained.

The results of TP1 (140° C.), TP2 (140° C.), and "TP2 (140° C.)/TP1 (140° C.)", TP1 (130° C.), and "TP2A/TP1A minimum temperature" in Examples 1 to 3 and Comparative Examples 1 to 4 are indicated in Table 2.

The results of the storage modulus G' (120° C.) and the softening point measured by the above method in Examples 1 and 2 and Comparative Examples 1 and 3 are indicated in Table 2.

TP1 (140° C.) and TP2 (140° C.) were measured in the same manner for commercially available "known toner in which a shell may be formed", and are indicated in Table 3 together with "TP2 (140° C.)/TP1 (140° C.)".

[Toner Performance]

<Tg Measurement>

Tg measurement by differential scanning calorimeter (DSC) was performed as follows using Q20 manufactured by TA Instruments. 3±1 mg of the toner was put into an aluminum pan and precisely weighed to a 0.1 mg digit, an aluminum pan filled with 3 mg of aluminum oxide was used as a reference, and the temperature was raised from 0° C. to 120° C. at a rate of 10° C./min in a nitrogen stream. After holding at 120° C. for 10 minutes, the temperature was cooled to 0° C. at 10° C./min, kept for 5 minutes, and then again raised to 120° C. at 10° C./min. The temperature at an intersection of a baseline before the endothermic peak at the second temperature rise and a tangent at the first inflection point appearing at 30° C. to 60° C. after starting of the endothermic peak was set as Tg (glass transition temperature). The Tg of the toner thus obtained is indicated in Table 2.

In a case where the sample of the polymerized primary particle and the shell fine particle was an aqueous dispersion, Tg was measured by the above method after freeze-drying to remove moisture. Tg was not measured in Example 3.

<Blocking Resistance>

10 g of the toner was put in a cylindrical container having an inner diameter of 3 cm and a height of 6 cm, a load of 20 g was applied thereto, the toner was left for 48 hours in an environment at a temperature of 45° C. and a humidity of 80%, then the toner was removed from the container, and the degree of aggregation was confirmed by applying the load from above. The collapse loads were determined by the following criteria, and the results were indicated in Table 2.

B: Collapse under load equal to or less than 100 g

D: Collapse under load of larger than 100 g

[Hot Offset Resistance]

The surface temperature of the roller was raised from 165° C. in 5° C. increments, and the recording paper on which the unfixed toner image having an attachment amount of about 1.2 mg/cm$^2$ was transported to a fixing nip portion so as to obtain a fixed image.

The degree of peeling of the fixed image at each temperature was visually determined.

The offset resistance was determined by the following criteria, and the results were indicated in Table 2.

B: fixed at a temperature equal to or higher than 195° C.

D: not fixed at 195° C., a part or all parts were peeled.

[Fixability]

<Low Temperature Fixability>

A recording paper (basis weight 80 g/m2 paper) on which an unfixed toner image was carried was prepared and a test was performed as follows by using a heat roll fixing type fixing machine.

The roller has a diameter of 27 mm, a nip width of 9 mm, and a fixing speed of 229 mm/sec, and was provided with a heater in the upper roller, and the surface of the roller was made of a tetrafluoroethylene-perfluoroalkyl vinyl ether copolymer (PFA), and was not coated with silicone oil.

The surface temperature of the roller was raised from 140° C. in 5° C. increments, and the recording paper on which the unfixed toner image having an attachment amount of about 1.2 mg/cm$^2$ was transported to a fixing nip portion so as to obtain a fixed image.

A mending tape was affixed to the fixed image, and a weight of 2 kg was passed thereon to bring the tape and the fixed image into close contact with each other. The mending tape was peeled off, and the extent to which the fixed image transferred to the tape was visually determined. The above test was performed three times, the low temperature fixability was determined by the following criteria using an average value of temperature at three times of fixing, and the results were indicated in Table 2.

A: fixed at a temperature equal to or lower than 145° C.

B: fixed at a temperature higher than 145° C. and equal to or lower than 150° C.

C: fixed at a temperature higher than 150° C. and equal to or lower than 155° C.

D: not fixed at 155° C.

TABLE 2

| | Viscoelasticity | | | | | | | Toner performances | | | Fixability Low |
|---|---|---|---|---|---|---|---|---|---|---|---|
| | TP1 (140° C.) | TP2 (140° C.) | TP2 (140° C.)/ TP1 (140° C.) | TP1 (130° C.) | Softening point (° C.) | G' (120° C.) | TP2A/TP1A minimum temperature (° C.) | Tg (° C.) | Blocking resistance | Hot offset resistance | temperature fixability |
| Example 1 | 3.25 | 2.97 | 0.91 | 3.01 | 107.8 | 1070 | 142 | 43.6 | B | B | A |
| Example 2 | 3.30 | 3.01 | 0.91 | 3.21 | 105.8 | 924 | 141 | 42.0 | B | B | A |
| Comparative Example 1 | 2.53 | 2.75 | 1.09 | 2.35 | 103.8 | 690 | 97 | 41.0 | B | D | C |
| Comparative Example 2 | 2.14 | 2.17 | 1.01 | 2.04 | Not measured | Not measured | 101 | 53.3 | B | B | D |
| Comparative Example 3 | 1.43 | 1.47 | 1.03 | 1.34 | 131.1 | 13242 | 95 | 42.1 | B | B | D |
| Comparative Example 4 | 2.53 | 2.53 | 1.00 | 2.33 | Not measured | Not measured | 80 | 52.5 | B | B | D |
| Example 3 | 2.31 | 2.04 | 0.88 | 2.70 | Not measured | Not measured | 130 | Not measured | B | B | B |

TABLE 3

| Manufacturer | Toner cartridge type | Color | TP1 (140° C.) | TP2 (140° C.) | TP2 (140° C.)/ TP1 (140° C.) |
|---|---|---|---|---|---|
| Fuji Xerox Co., Ltd. | CT201399 | Cy toner | 1.76 | 1.79 | 1.02 |
| | CT200248 | Cy toner | 0.95 | 1.08 | 1.14 |
| Konica Minolta Co., Ltd. | TN-512C | Cy toner | 1.54 | 1.11 | 0.72 |
| Ricoh Company, Ltd. | 600284 | Cy toner | 0.85 | 0.87 | 1.02 |
| Hewlett-Packard | CF361A | Cy toner | 2.24 | 1.97 | 0.88 |
| Company | CE250A | Cy toner | 2.04 | 1.65 | 0.81 |
| Brother Industries Ltd. | TN315C | Cy toner | 0.78 | 0.78 | 0.99 |

<Results>

As apparent from Table 2, in the toner of Examples 1 to 3, the blocking resistance was maintained, both of the excellent fixability at a low temperature and the hot offset resistance can be realized; whereas in the toner of Comparative Examples 1 to 4, both of the excellent fixability at a low temperature and the blocking resistance cannot be realized, and either one of the excellent fixability at a low temperature and the blocking resistance was deteriorated.

Example 4

<Adjustment of Magenta Colorant Dispersion>

In a container with an inner volume of 300 L equipped with a stirrer (propeller blade), pigment red 238 of magenta pigment, that is, 20 parts (40 kg) of N-(5-chloro-2-methoxyphenyl)-3-hydroxy-4-[[2-methoxy-5-[(phenylamino) carbonyl]phenyl]azo]naphthalene-2-carboxamide, 1 part of a 20% aqueous solution of sodium dodecylbenzene sulfonate, 4 parts of polyoxyethylene lauryl ether of HLB 15.3, 75 parts of ion-exchanged water having an electric conductivity equal to or smaller than 1.5 μS/cm was added and preliminarily dispersed to obtain a pigment premix solution.

The pigment premix solution was supplied to a wet bead mill as a raw material slurry, and was circulated and dispersed. An inner diameter of a stator was φ 75 mm, a diameter of a separator was 60 mm, a distance between the separator and a disk was 15 mm, and zirconia beads (true density 6.0 g/cm$^3$) having a diameter of 50 μm were used as media for dispersion. An effective inner volume of the stator was 0.5 L, and a filling volume of the media was 0.35 L, so that a media filling rate was 70% by mass. A rotary speed of the rotor was constant (a circumferential speed of a rotor tip is 11 m/sec), the pigment premix solution was continuously supplied from a supply port at a supply rate of 50 L/hr by a non-pulsation constant rate pump and continuously discharged from a discharge port, these were repeated and circulated to obtain a magenta colorant dispersion when a predetermined particle diameter was reached. A volume median diameter of the magenta colorant dispersion measured with a Nanotrac was 151 nm, pH was 5.8, and a solid content concentration was 25.5% by mass.

<Preparing of Toner Base Particle Dispersion 3A: Aggregation Step>

The obtained 72.0 parts (solid content) of primary polymer particle B1, 0.15 part (solid content) of 20% DBS aqueous solution, 22 parts of deionized water, 0.49 part (solid content) of 5% iron sulfate (II) heptahydrate aqueous solution, and 32.5 parts of the magenta colorant dispersion were sequentially added to a reactor equipped with a stirring device, a heating and cooling device, and each raw material and auxiliaries charging device while stirring and mixed homogeneously.

Thereafter, 0.08 part (solid content) of 0.5% aluminum sulfate aqueous solution was added for 8 minutes, and 41 parts of deionized water was added for 6 minutes. Subsequently, the internal temperature was raised to 40° C., and the temperature was raised stepwise until the volume median diameter became 5.1 μm. This temperature (primary aggregation temperature) was 46° C.

Promptly, lowering the temperature was rapidly lowered by 2° C. from the primary aggregation temperature and simultaneously adding 8.0 parts (solid content) of primary polymer particle B1. After 30 minutes, 20.0 parts (solid content) of the shell fine particle C1 was added. After 80 minutes, 4.0 parts (solid content) of 20% DBS aqueous solution and 23 parts of deionized water were added, then the temperature was raised up to 75° C. for 70 minutes, and thereafter, the temperature was raised stepwise until the circularity became 0.966. The temperature (final circulation temperature) when the circularity reached 0.966 was 80° C. Then, the temperature was rapidly cooled to 30° C., and thereby a toner base particle dispersion 3A was obtained.

<Preparing of Toner Base Particle 3A: Washing and Drying Step>

A toner base particle 3A was obtained in the same method as the toner base particle 1 except that the toner base particle dispersion 3A was used instead of the toner base particle dispersion 1.

<Preparing of Toner 3A: External Addition Step>

A sample mill (manufactured by Kyoritsu Riko Co., Ltd.) was preheated to 30° C. 0.40 part of the external additive W (silica particle), 0.15 part of the external additive X (positively charging silica particle), 1.20 parts of the external additive Y (composite oxide particle), and 0.75 part of the external additive Z (silica particle having large particle diameter) with respect to 100 parts of the toner base particle 3A obtained above were added, stirred at 4000 rpm for 11 minutes, mixed, externally added, and sieved to obtain toner 3A.

Example 5

<Preparing of Toner Base Particle Dispersion 4A: Aggregation Step>

The obtained 82.8 parts (solid content) of primary polymer particle B1, 0.17 part (solid content) of 20% DBS aqueous solution, 25 parts of deionized water, 0.49 part (solid content) of 5% iron sulfate (II) heptahydrate aqueous solution, and 32.5 parts of the magenta colorant dispersion were sequentially added to a reactor equipped with a stirring device, a heating and cooling device, and each raw material and auxiliaries charging device while stirring and mixed homogeneously. Thereafter, 0.08 part (solid content) of 0.5% aluminum sulfate aqueous solution was added for 8 minutes, and 41 parts of deionized water was added for 6 minutes. Subsequently, the internal temperature was raised to 43° C., and the temperature was raised stepwise until the volume median diameter became 5.2 μm. This temperature (primary aggregation temperature) was 45° C.

Promptly, lowering the temperature was rapidly lowered by 2° C. from the primary aggregation temperature and simultaneously adding 9.2 parts (solid content) of primary polymer particle B1. After 60 minutes, 8.0 parts (solid content) of the shell fine particle C1 was added. After 60 minutes, 4.0 parts (solid content) of 20% DBS aqueous solution and 23 parts of deionized water were added, then the temperature was raised up to 74° C. for 70 minutes, and thereafter, the temperature was raised stepwise until the circularity became 0.966. The temperature (final circulation temperature) when the circularity reached 0.966 was 78° C. Then, the temperature was rapidly cooled to 30° C., and thereby a toner base particle dispersion 4A was obtained.

<Preparing of Toner Base Particle 4A: Washing and Drying Step>

A toner base particle 4A was obtained in the same method as the toner base particle 1 except that the toner base particle dispersion 4A was used instead of the toner base particle dispersion 1.

<Preparing of Toner 4A: External Addition Step>

A toner 4A was obtained in the same method as the toner 3A except that the toner base particle 4A was used instead of the toner base particle 3A.

By using the toners obtained in Examples 4 and 5, a test was performed according to each test method described above. The results were shown in Table 4.

TABLE 4

| | Viscoelasticity | | | Toner performances | | | Fixability Low |
|---|---|---|---|---|---|---|---|
| | TP1 (12° C.) | TP2 (12° C.) | TP2 (12° C.)/ TP1 (12° C.) | Tg (° C.) | Blocking resistance | Hot offset resistance | temperature fixability |
| Example 4 | 1.93 | 1.28 | 0.66 | 42.2 | B | B | B |
| Example 5 | 1.79 | 1.09 | 0.61 | 41.7 | B | B | B |

As apparent from Table 4, in toners of Examples 4 to 5, the blocking resistance was maintained, and both of the excellent fixability at a low temperature and the hot offset resistance can be achieved.

Although the present invention has been described in detail with reference to particular embodiments, it will be apparent to those skilled in the art that various changes and modifications can be made without departing from the spirit and scope of the present invention. The present application is based on Japanese Patent Application No. 2017-008706 filed on Jan. 20, 2017, Japanese Patent Application No. 2017-008707 filed on Jan. 20, 2017, and Japanese Patent Application No. 2017-013610 filed on Jan. 27, 2017, the contents of which are incorporated herein by reference.

INDUSTRIAL APPLICABILITY

The electrostatic charge image developing toner of the present invention has excellent blocking resistance, and can achieve both of the excellent fixability at a low temperature and the hot offset resistance, and thus is widely used in not only the field of image formation for visualizing electrostatic images such as printers, copying machines, and facsimile machines, but also the professional field where high glossiness and high glossiness are required and images such as photographs and graphics need to be beautifully output.

In addition, the electrostatic charge image developing toner of the present invention has excellent blocking resistance and is capable of realizing both of the excellent fixability at a low temperature and the hot offset resistance, and thus is widely used in not only the field of image formation for visualizing electrostatic images such as printers, copying machines, and facsimile machines.

REFERENCE SIGNS LIST

1 Structure formed of shell component and external additive (discontinuous portions may be employed)

2 Core component (components constituting central portion of toner)

3 Tan δ curve and TP1 (140° C.) in the first measurement

4 Tan δ curve and TP1 (140° C.) in the second measurement

The invention claimed is:

1. An electrostatic charge image developing toner, wherein when a tab δ measurement is performed twice by a rheometer, in the first measurement, a tab δ value measured at 130° C. is set as TP1 (130° C.) and a tan δ value measured at 140° C. is set as TP1 (140° C.), and in the second measurement, a tan δ value measured at 140° C. is set as TP2 (140° C.), TP2 (140° C.)/TP1 (140° C.) is equal to or smaller than 0.95, and TP1 (130° C.) is equal to or greater than 2.5.

2. The electrostatic charge image developing toner according to claim 1, wherein TP2 (140° C.)/TP1 (140° C.) is equal to or greater than 0.50.

3. The electrostatic charge image developing toner according to claim 1, wherein TP1 (130° C.) is equal to or smaller than 4.0.

4. The electrostatic charge image developing toner according to claim 1, comprising:

a toner base particle containing at least a binder resin and a colorant; and an external additive.

5. The electrostatic charge image developing toner according to claim 1, wherein a storage modulus G' measured at 120° C. by a rheometer is equal to or lower than 2,000 Pa, and a softening point measured by a flow tester is equal to or higher than 105° C.

6. The electrostatic charge image developing toner according to claim 1, comprising:

a core component containing at least a binder resin and a colorant; and a core/shell structure containing a shell component which has at least a binder resin present in surroundings thereof, wherein a degree of crosslinking of the core component is higher than a degree of crosslinking of the shell component, and a polarity of the shell component is higher than a polarity of the core component.

7. The electrostatic charge image developing toner according to claim 6, wherein a glass transition temperature of the binder resin contained in the core component is at least 5° C. lower than the glass transition temperature of the binder resin contained in the shell component.

8. The electrostatic charge image developing toner according to claim 1, having a volume average particle diameter of 4 μm to 8 μm.

9. The electrostatic charge image developing toner according to claim 1, having an average circularity of 0.95 to 0.99.

10. The electrostatic charge image developing toner according to claim 1, comprising: a copper phthalocyanine dye pigment as a colorant.

11. An electrostatic charge image developing toner, wherein when a tab δ measurement is performed twice by a rheometer, in the first measurement, a tab δ value measured at 140° C. is set as TP1 (140° C.) and a tab δ value measured at 80° C. to 150° C. is set as TP1A, and in the second measurement, a tab δ value measured at 140° C. is set as TP2 (140° C.) and a tab δ value measured at 80° C. to 150° C. is set as TP2A, TP2 (140° C.)/TP1 (140° C.) is equal to or smaller than 0.95, and a temperature at which TP2A/TP1A shows a minimum value is equal to or higher than 130° C.

12. An electrostatic charge image developing toner, wherein when a tab δ measurement is performed twice by a rheometer, in the first measurement, a tab δ value measured at 140° C. is set as TP1 (140° C.), and in the second measurement, a tab δ value measured at 140° C. is set as TP2 (140° C.), TP2 (140° C.)/TP1 (140° C.) is 0.90 to 0.95; or when a tab δ measurement is performed twice by a rheometer, in the first measurement, a tab δ value measured at 120° C. is set as TP1 (120° C.), and in the second measurement, a tab δ value measured at 120° C. is set as TP2 (120° C.), TP2 (120° C.)/TP1 (120° C.) is 0.60 to 0.70.

* * * * *